United States Patent [19]

Misumi et al.

[11] Patent Number: 4,795,688

[45] Date of Patent: Jan. 3, 1989

[54] LAYERED PHOTOCONDUCTIVE MEMBER COMPRISING AMORPHOUS SILICON

[75] Inventors: Teruo Misumi, Kawasaki; Kyosuke Ogawa, Tokyo; Junichiro Kanbe, Yokohama; Keishi Saitoh, Tokyo; Yoichi Osato, Yokohama; Shigeru Shirai, Yamato, all of Japan

[73] Assignee: Canon Kabushiki Kaisha, Tokyo, Japan

[21] Appl. No.: 39,448

[22] Filed: Apr. 17, 1987

Related U.S. Application Data

[63] Continuation-in-part of Ser. No. 837,558, Mar. 3, 1986, abandoned, which is a continuation of Ser. No. 700,078, Feb. 11, 1985, abandoned, which is a continuation of Ser. No. 475,372, Mar. 14, 1983, abandoned.

[51] Int. Cl.[4] ..... G03G 5/14

[52] U.S. Cl. ..... 430/65; 430/66; 430/84; 430/95

[58] Field of Search ..... 430/57, 63, 65, 88, 430/84, 95

[56] References Cited

U.S. PATENT DOCUMENTS

| | | | |
|---|---|---|---|
| 4,217,374 | 8/1980 | Ovshinsky et al. | 427/39 |
| 4,225,222 | 9/1980 | Kempter | 355/3 |
| 4,226,898 | 10/1980 | Ovshinsky et al. | 427/39 |
| 4,265,991 | 5/1981 | Hirai et al. | 430/64 |
| 4,394,425 | 7/1983 | Shimizu et al. | 430/65 |
| 4,403,026 | 9/1983 | Shimizu et al. . | |
| 4,409,311 | 10/1983 | Kawamura et al. . | |
| 4,414,319 | 11/1983 | Shirai et al. . | |
| 4,423,133 | 12/1983 | Kanbe et al. | 430/95 |
| 4,452,874 | 6/1984 | Ogawa et al. | 430/57 |
| 4,452,875 | 6/1984 | Ogawa et al. | 430/57 |
| 4,460,669 | 7/1984 | Ogawa et al. | 430/57 |
| 4,460,670 | 7/1984 | Ogawa et al. | 430/57 |
| 4,465,750 | 8/1984 | Ogawa et al. | 430/57 |
| 4,471,042 | 9/1984 | Komatsu et al. | 430/64 |
| 4,483,911 | 11/1984 | Ogawa et al. | 430/65 |
| 4,486,521 | 12/1984 | Misumi et al. | 430/65 |
| 4,490,453 | 12/1984 | Shirai et al. | 430/65 |
| 4,490,454 | 12/1984 | Misumi et al. | 430/84 |
| 4,501,807 | 2/1985 | Shirai et al. | 430/57 |
| 4,522,905 | 6/1985 | Ogawa et al. | 430/60 |
| 4,536,459 | 8/1985 | Misumi et al. | 430/57 |
| 4,536,460 | 8/1985 | Kanbe et al. | 430/57 |
| 4,539,283 | 9/1985 | Shirai et al. | 430/61 |
| 4,547,448 | 10/1985 | Shirai et al. | 430/84 |
| 4,565,731 | 1/1986 | Komatsu et al. | 428/212 |
| 4,636,450 | 1/1987 | Ogawa et al. | 430/84 |

*Primary Examiner*—J. David Welsh

*Attorney, Agent, or Firm*—Fitzpatrick, Cella, Harper & Scinto

[57] ABSTRACT

A photoconductive member comprises a support for a photoconductive member and an amorphous layer having photoconductivity and containing an amorphous material comprising silicon atom as a matrix, said amorphous layer having a first layer region containing oxygen atoms and a second layer region containing Group III atoms of the Periodic Table Such that said Group III atoms are continuously distributed in the direction of the layer thickness and enriched at the support side and wherein oxygen is absent from said amorphous layer exclusive of the first layer region, said first layer region being present internally in the support side portion of the amorphous layer, and there being the following relationship:

$$To/T \leqq 1$$

where To is the layer thickness of the first layer region and T results from subtracting To from the layer thickness of the amorphous layer.

21 Claims, 9 Drawing Sheets

LAYERED PHOTOCONDUCTIVE MEMBER COMPRISING AMORPHOUS SILICON

This application is a continuation-in-part of application Ser. No. 837,558, filed Mar. 3, 1986, now abandoned, which was a continuation of application Ser. No. 700,078, filed Feb. 11, 1985, now abandoned, which was a continuation of application Ser. No. 475,372, filed Mar. 14, 1983, now abandoned.

BACKGROUND OF THE INVENTION

1. Field of the Invention

This invention relates to a photoconductive member having sensitivity to electromagnetic waves such as light (herein used in a broad sense, including ultraviolet rays, visible light, infrared rays, X-rays and gamma-rays and the like).

2. Description of the Prior Art

Photoconductive materials constituting photoconductive layers for solid state image pick-up devices, electrophotographic image forming members in the field of image formation, or manuscript reading devices are required to have a high sensitivity, a high SN ratio (Photocurrent (Ip)/Dark Current (Id)), absorption spectral characteristics matching to the spectral characteristics of irradiating electromagnetic waves, a good response to light, a desired dark resistance value as well as not causing harm to human bodies during usage. Further, in a solid state image pick-up device, it is also required that the residual image should be easily treated within a predetermined time. In particular, in case of an image forming member for electrophotography to be assembled in an electrophotographic device to be used in an office as office apparatus, the aforesaid safety characteristic is very important.

From the standpoint as mentioned above, amorphous silicon (hereinafter referred to as "a-Si") has recently attracted attention as a photoconductive material. For example, German Laid-Open Patent Publication Nos. 2746967 and 2855718 disclose applications of a-Si for use in image forming members for electrophotography, and German Laid-Open Patent Publication No. 2933411 discloses application of a-Si for use in a photoelectric converting reading device.

However, under the present situation, although the photoconductive members having photoconductive layers constituted of a-Si of the prior art have been attempted to be improved with respect to individual characteristics, including various electrical, optical and photoconductive characteristics such as dark resistance value, photosensitivity and response to light, environmental characteristics in use, and further stability with lapse of time and durability, there exists room for further improvement in overall characteristics.

For instance, when the a-Si photoconductor is applied to an image forming member for an electrophotographic device, residual potential is frequently observed to remain during use thereon if increases in both photosensitivity and dark resistance are contemplated.

When such a photoconductive member is repeatedly used for a long time, there will be caused various inconveniences such as accumulation of fatigues by repeated uses or so-called ghost phenomenon wherein residual images are formed.

Further, a-Si materials may contain as constituent atoms hydrogen atoms or halogen atoms such as fluorine atoms, chlorine atoms, etc. for improving their electrical, photoconductive characteristics, and boron atoms, phosphorus atoms, etc. for controlling the electroconductivity type, and further other atoms for improving other characteristics. Depending on the manner in which these constituent atoms are contained, there may sometimes be caused problems with respect to electrical, or photoconductive characteristics, or dielectric strength of the layer formed.

For example, there are problems as shown below. Life of photocarriers produced in the formed photoconductive layer by irradiation is not sufficiently long in the layer. Injection of electric charge from the support side cannot be sufficiently prevented at the dark portions.

Thus, it is required in designing a photoconductive material to make efforts to overcome all of such problems as mentioned above along with the improvement of a-Si materials per se.

In view of the above points, the present invention contemplates the achievement obtained as a result of extensive studies made comprehensively from the standpoints of applicability and utility of a-Si as a photoconductive member for image forming members for electrophotography, solid state pick-up devices and reading devices etc. It has now been found that a photoconductive member having a photoconductive layer comprising a-Si, in particular, an amorphous material constituted of at least one of hydrogen atom (H) and halogen atom (X) in a matrix of silicon (hereinafter referred to comprehensively as "a-Si (H, X)"), (for example, so-called hydrogenated amorphous silicon, halogenated amorphous silicon or halogen-containing hydrogenated amorphous silicon), exhibits not only practically extremely good characteristics, but also surpasses conventional photoconductive members in substantially all aspects, provided that the photoconductive member is constituted to have a specific layer structure as explained in the following. The photoconductive member has markedly excellent characteristics for electrophotography.

The present invention is based on the above mentioned discovery.

SUMMARY OF THE INVENTION

An object of the present invention is to provide a photoconductive member having substantially constantly stable electrical, optical and photoconductive characteristics, suffering from substantially no influence from the use environment, and being markedly excellent in light fatigue resistance, excellent in durability without causing any deterioration phenomenon after repeated uses and entirely or substantially free from residual potentials.

Another object of the present invention is to provide a photoconductive member which is sufficiently capable of bearing charges at the time of charging treatment for formation of electrostatic charges to an extent that a conventional electrophotographic method can be very effectively applied when it is provided for use as an image forming member for electrophotography.

Still another object of the present invention is to provide a photoconductive member for electrophotography capable of providing easily a high quality image which is high in density, clear in half-tone and high in resolution.

A further object of the present invention is to provide a photoconductive member having high photosensitivity, high SN ratio characteristic and high dielectric strength.

According to the present invention, there is provided a photoconductive member which comprises a support for a photoconductive member and an amorphous layer having photoconductivity and containing an amorphous material comprising silicon atom as a matrix, said amorphous layer having a first layer region containing oxygen atoms and a second layer region containing Group III atoms of the Periodic Table such that the Group III atoms are continuously distributed in the direction of the layer thickness and enriched at the support side, and wherein oxygen is absent from said amorphous layer exclusive of the first layer region, said first layer region being present internally in the support side portion of the amorphous layer, and there being the following relationship:

$$To/T \leqq 1$$

where To is the layer thickness of the first layer region and T results from subtracting To from the layer thickness of the amorphous layer.

DESCRIPTION OF THE PREFERRED EMBODIMENTS

Figure 1:
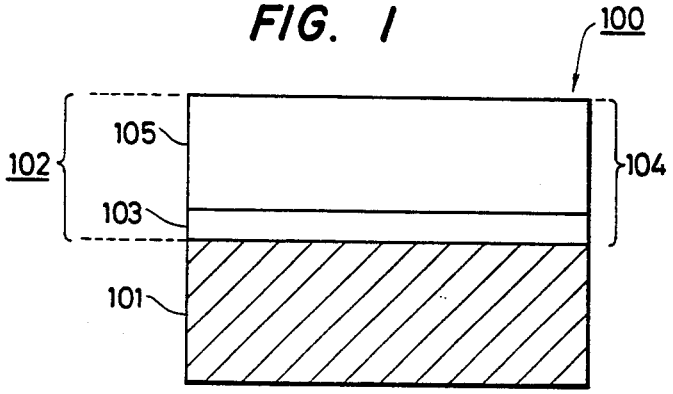
FIG. 1 and FIG. 11 schematically show embodiments of the layer structure of the photoconductive member of the present invention.

Referring to the drawings, the photoconductive member of the present invention will be explained below.

Referring to FIG. 1, a photoconductive member 100 is constituted of a support 101 and an amorphous layer 102 exhibiting photoconductivity, comprising a-Si, in support, a-Si (H, X), and overlying the support 101.

The amorphous layer 102 has a first layer region (O) 103 containing oxygen atoms as a constituent atom and a second layer region (III) 104 containing a Group III atom as a constituent atom such that the Group III atoms are distributed continuously in the direction of the layer thickness and are enriched at the support 101 side.

In the example of FIG. 1, the second layer region (III) 104 occupies the whole layer region of amorphous layer 102, and the first layer region (O) 103 constitutes a part of the second layer region (III) 104 and exists internally below the surface of amorphous layer 102.

An upper layer region 105 of amorphous layer 102 does not contain oxygen atoms which may affect a humidity resistance and corona ion resistance. Oxygen atoms are contained only in the first layer region (O) 103.

Oxygen atoms are incorporated only in the first layer region (O) 103 for the purpose of enhancing primarily the dark resistance and the adhesion between support 101 and amorphous layer 102. On the contrary, oxygen atoms are not incorporated in upper layer region 105 for the purpose of enhancing the sensitivity.

The oxygen atoms contained in the first layer region (O) 103 are distributed continuously and substantially uniformly in the direction of the layer thickness and are also distributed substantially uniformly in the plane parallel to the interface between the support 101 and the amorphous layer 102.

As the Group III atoms contained in the second layer region (III) 104 constituting the amorphous layer 102, there may be mentioned B (boron), Al (aluminum), Ga (gallium), In (indium), Tl (thallium) and the like, with B and Ga preferred.

The Group III atom is distributed in the second layer region (III) 104 such that the distribution in the direction of layer thickness is as mentioned above and the distribution in the plane parallel to the surface of the support 101 is substantially uniform.

The layer thickness of the first layer region (O) 103 and that of the upper layer region 105 are important factors for attaining the objects of the present invention so that they should be carefully selected upon designing the photoconductive member to impart desirable characteristics to the photoconductive member.

The layer thickness of the first layer region (O) 103, To, is preferably 50μ or less, more preferably 30μ or less, most preferably 10μ or less.

The layer thickness of upper layer region 105, T, is preferably 0.5μ or more, more preferably 1μ or more, most preferably 3μ or more.

The lower limit of the layer thickness To of the first layer region (O) 103 and the upper limit of the layer thickness T of the upper layer region 105 may be suitably determined as desired based on the organic relation between the required characteristics of both layer regions and the required characteristics of the whole amorphous layer 102 upon designing the photoconductive member.

According to the present invention, the lower limit of the layer thickness To and the upper limit of the layer thickness T are appropriately selected to satisfy the relationship:

$$To/T \leqq 1$$

The layer thickness To and the layer thickness T are selected to satisfy $To/T \leqq 1$, preferably $To/T \leqq 0.9$, more preferably $To/T \leqq 0.8$.

In FIG. 1 illustrating an embodiment of the photoconductive member according to the present invention, an atom of Group III of the Periodic Table as a constituent atom, and the whole portion of an amorphous layer 102 may be the second layer region (III) 104. Alternatively the upper layer region 105 may not contain any atom of Group III, and the first layer region (O) and the second layer region (III) may be the same layer region.

The photoconductive member not containing an atom of Group III in the upper layer region 105 exhibits a better repeated use characteristics under a highly humid atmosphere, that is, a sufficient durability for a long time use under a highly humid atmosphere.

In addition, a further embodiment is that the second layer region (III) is formed in the first layer region (O).

The amount of oxygen atom contained in the first layer region (O) may be determined accordingly depending upon the required characteristics of the photoconductive member to be formed, and it is preferably 0.001–50 atomic %, more preferably 0.002–40 atomic %, and most preferably 0.003–30 atomic %.

When the layer thickness To of the first layer region (O) is sufficiently thick or To is more than 2/5 times the total thickness of the first amorphous layer (I), (To+T), the upper limit of oxygen atom contained in the first layer region (O) is preferably 30 atomic %, more preferably 20 atomic %, most preferably 10 atomic %.

According to the present invention, the layer thickness (To+T) is preferably 1–100μ, more preferably 1–80μ, most preferably 2–50μ, from the standpoint of the desired electrophotographic characteristics and economy.

FIGS. 2 through 10 show typical examples of the distribution in the direction of layer thickness of the Group III atoms contained in the second layer region (III) of the amorphous layer in the photoconductive member according to the present invention.

In the examples of FIGS. 2–10, the first layer region (O) containing oxygen atoms may be the same layer region as the second layer region (III), contain the second layer region (III), or share with the second layer region (III) in common at least a portion of said mutual region. Therefore, in the following description the first layer region (O) containing oxygen atom will not be referred to unless any particular explanation is necessary.

In FIGS. 2 through 10, the abscissa indicates the content C of the Group III atoms and the ordinate the layer thickness t of the second layer region (III) constituting the amorphous layer exhibiting photoconductivity, $t_B$, showing the position of the interface on the support side and $t_T$ the position of the interface on the side opposite to the support side. That is, the second layer region (III) containing the Group III atoms is formed from the $t_B$ side toward the $t_T$ side.

In the present invention, the second layer region (III) is composed of a-Si (H, X) constituting the photoconductive member, and it may occupy either the whole region of the amorphous layer exhibiting photoconductivity or a part thereof.

In the present invention, when the aforesaid second layer region (III) occupies a part of the amorphous layer, it is preferred in an example shown in FIG. 1 that said layer should be provided as the lower layer region of the amorphous layer 102 containing the interface on the side of the support 101.

Figure 2:
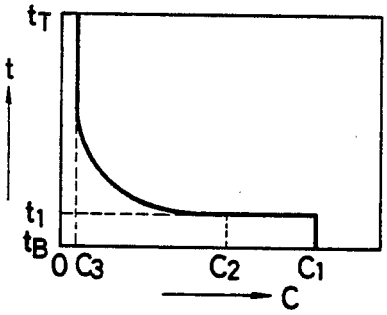
FIG. 2–FIG. 10 show examples of the distribution of the Group III atoms in the second layer region (III) of the amorphous layer according to the present invention.

In FIG. 2, there is shown a first typical example of the distribution of the Group III atoms in the layer thickness direction contained in the second layer region (III).

According to the example as shown in FIG. 2, from the interface position $t_B$ to the other interface position $t_1$, the Group III atoms are contained in the second layer region (III) formed with the concentration C of the Group III atoms taking a constant value of $C_1$, and from the position $t_1$ to the interface position $t_T$, the concentration C being gradually decreased from the concentration $C_2$. At the interface position $t_T$, the concentration C of the Group III atoms is made $C_3$.

Figure 3:
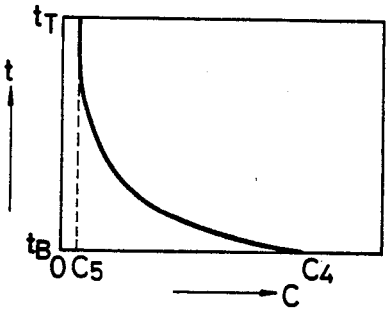

In the example as shown in FIG. 3, there is created a distribution such that the concentration C of the Group III atoms is continuously gradually decreased from the position $t_B$, to the position $t_T$ from the concentration $C_4$, until it becomes the concentration $C_5$ at the position $t_T$.

Figure 4:
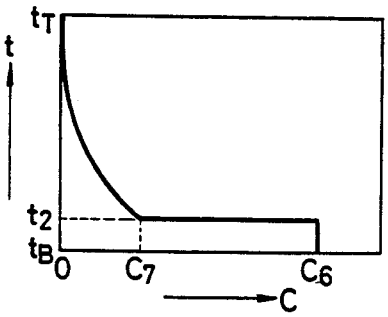

In case of FIG. 4, the concentration C of the Group III atoms is maintained at a constant value of $C_6$ from the position $t_B$ to the position $t_2$, gradually continuously decreased between the position $t_2$ and the position $t_T$, and at the position $t_T$ the concentration C is made substantially zero.

Figure 5:
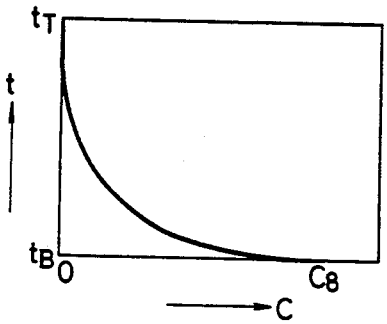

In case of FIG. 5, the Group III atoms are continuously gradually decreased in concentration from the concentration $C_8$ from the position $t_B$ to the position $t_T$ at which the concentration is made substantially zero.

Figure 6:
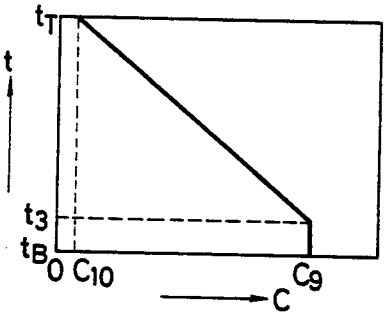

In the example shown in FIG. 6, the concentration C of the Group III atoms is maintained at a constant value of $C_9$, from the position $t_B$ to $t_3$ and is made $C_{10}$ at the position $t_T$. Between the position $t_3$ and the position $t_T$, the concentration C is decreased in a linear function from the position $t_3$ to the position $t_T$.

Figure 7:
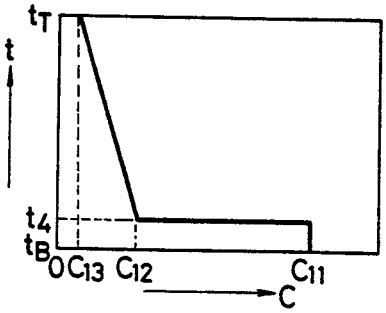

In the example as shown in FIG. 7, the distribution is made such that a constant value of $C_{11}$ is taken from the position $t_B$ to the position $t_4$, and the concentration C is decreased in a linear function from the concentration $C_{12}$ to the concentration $C_{13}$ from the position $t_4$ to the position $t_T$.

Figure 8:
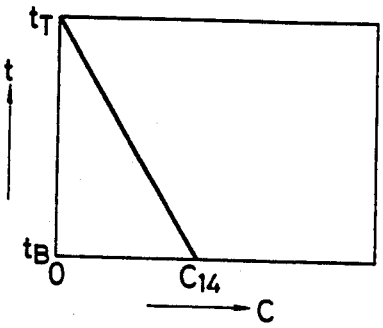

In the example as shown in FIG. 8, the concentration C of the Group III atoms is decreased from the position $t_B$ to the position $t_T$ in a linear function from the concentration $C_{14}$ to zero.

Figure 9:
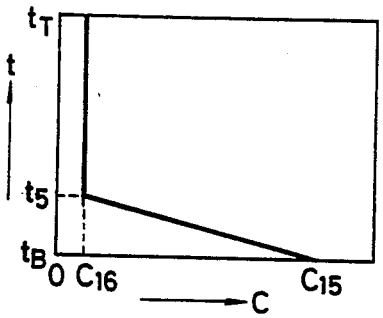

In FIG. 9, there is shown an example in which the concentration C of the Group III atoms is decreased from the position $t_B$ to the position $t_5$ in a linear function from the concentration $C_{15}$ to the concentration $C_{16}$, and maintained at a constant value of $C_{16}$ between the position $t_5$ and the position $t_T$.

Figure 10:
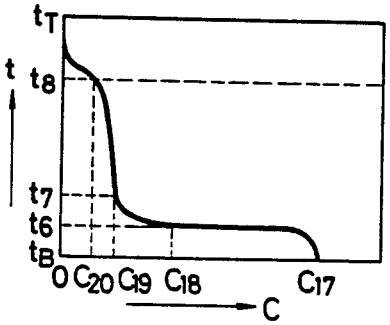

In the example as shown in FIG. 10, the concentration C of the Group III atoms is the concentration $C_{17}$ at the position $t_B$, which is then initially gradually decreased to the position $t_6$ and abruptly decreased near the position $t_6$ to the concentration $C_{18}$ at position $t_6$. Between the position $t_6$ and the position $t_7$, the concentration is abruptly decreased at the beginning and then gradually decreased and becomes the concentration $C_{19}$ at the position $t_7$, and because the position $t_7$ and the position $t_8$ with a very gradual decrease, reaches the concentration $C_{20}$ at $t_8$. Between the position $t_8$ and the position $t_T$, the concentration is decreased from $C_{20}$ along the curve as shown in the drawing to substantially zero.

In the above, there are shown some typical examples of the distributions in the layer thickness direction of the Group III atoms contained in the second layer region (III). In the present invention, there may be provided in the amorphous layer a second layer region (III), having a portion with higher value of the concentration C of the Group III atoms on the support side, and having a portion with said concentration C which has been made considerably lower on the interface $t_T$ side, as compared with that on the support side.

In the present invention, the second layer region (III) constituting the amorphous layer has a localized region (A) containing the Group III atoms at a higher concentration on the support side as described above.

The localized region (A) may preferably be provided at a position, in terms of the symbols shown in FIGS. 2 to 10, within 5μ from the interface position $t_B$.

In the present invention, in such a case as described above, the above localized region (A) may be made the whole layer region ($L_T$) ranging from the interface position $t_B$ to the 5-micron thickness in some cases, or a part thereof in other cases.

It may be suitably determined depending on the characteristics required for the amorphous layer formed, whether the localized region (A) should be made a part or whole of the layer region ($L_T$).

The localized region (A) may be desirably formed so that the Group III atoms may be distributed in the layer thickness direction with the maximum distribution value of the Group III atoms (concentration distribution value) $C_{max}$ being generally 50 atomic ppm or more, preferably 80 atomic ppm or more, most preferably 100 atomic ppm or more.

That is, in the present invention, the second layer region (III) may be preferably formed so that the maximum value $C_{max}$ of the content distribution may exist at a depth within 5μ of layer thickness from the support side (layer region of 5μ thickness from $t_B$).

In the present invention, the content of the Group III atoms to be contained in the aforesaid second layer region (III) may be suitably determined as desired to achieve the object of the present invention. It is preferably in the range from 0.01 to $5\times10^4$ atomic ppm, more preferably from 0.5 to $1\times10^4$ atomic ppm, most preferably from 1 to $5\times10^3$ atomic ppm.

A support used in the present invention may be electroconductive or electrically insulating. As the electroconductive support, there may be mentioned metals such as NiCr, stainless steel, Al, Cr, Mo, Au, Nb, Ta, V, Ti, Pt, Pd and the like and alloys thereof.

As the electrically insulating support, there may be mentioned synthetic resin films or sheets such as polyester, polyethylene, polycarbonate, cellulose acetate, polypropylene, polyvinyl chloride, polyvinylidene chloride, polystyrene, polyamides and the like, glass, ceramics, paper and the like.

These electrically insulating supports are preferably used such that at least one surface of the support is electroconductivized and a layer or layers are mounted on said electroconductivized surface.

For example, glass is electroconductivized by forming on the surface a thin film of NiCr, Al, Cr, Mo, Au, Ir, Nb, Ta, V, Ti, Pt, Pd, $In_2O_3$, $SnO_2$, ITO ($In_2O_3$+-$SnO_2$) and the like, and synthetic resin films such as polyester film and the like are electroconductivized by forming a thin film of a metal such as NiCr, Al, Ag, Pb, Zn, Ni, Au, Cr, Mo, Ir, Nb, Ta, V, Ti, Pt and the like according to vacuum deposition, electron beam deposition, sputtering or the like, or by laminating the surface with the abovementioned metal.

The shape of the support may be optionally selected, and may be, for example, drum, belt, plate or the like. For example, when the photoconductive member 100 in FIG. 1 is used as an image forming member for electrophotography, an endless belt form or drum form is preferable for a continuous high speed copying.

The thickness of the support may be optionally determined so as to obtain a desired photoconductive member. When the photoconductive member is required to be flexible, the thickness is made as thin as possible as far as the function of support can be sufficiently exhibited. The thickness is usually 10μ or more from the standpoints of manufacturing the support, handling and the mechanical strength.

The amorphous layer composed of a-Si (H, X) according to the present invention may be produced by, for example, a vacuum deposition method utilizing discharging phenomenon such as glow discharge, sputtering, ion plating and the like.

For producing the amorphous layer composed of a-Si (H, X) by glow discharge, a starting gas for supplying Si atom together with a starting gas for introducing H atom and/or a starting gas for supplying a halogen atom (X) were introduced into a deposition chamber which can be brought into a reduced pressure, and glow discharge is generated in said chamber to form an a-Si (H, X) layer on a predetermined surface of the support set at a predetermined position.

When sputtering method is used, sputtering is effected using an Si target in an atmosphere of an inert gas such as Ar, He and the like or a gas mixture based on such inert gas, and, upon this sputtering, a gas or gases for introducing hydrogen atom (H) and/or halogen atom (X) are introduced into the deposition chamber for sputtering.

As a halogen atom (X) contained in the amorphous layer, if desired, according to the present invention, there may be mentioned fluorine, chlorine, bromine, and iodine, preferred with fluorine and chlorine.

As a gas for supplying Si, there may be mentioned gaseous or gasifiable silicon hydrides (silanes) such as $SiH_4$, $Si_2H_6$, $Si_3H_8$, $Si_4H_{10}$, and the like, and in particular, $SiH_4$, $Si_2H_6$, are preferable because of easy procedure for producing the layer and good efficiency for supplying Si.

As effective starting gases for introducing a halogen atom, there may be used many halogen compounds, for example, gaseous or gasifiable halogen compounds such as halogen gases, halides, interhalogen compounds, halogen substituted silane derivatives and the like. In addition, there may be preferably used gaseous or gasifiable silicon compounds containing halogen atom(s) constituted of silicon atom and halogen atom.

Halogen compounds preferably used are halogen gases such as fluorine, chlorine, bromine and iodine, and interhalogen compounds such as BrF, ClF, $ClF_3$, $BrF_5$, $BrF_3$, $IF_3$, $IF_7$, ICl, IBr, and the like.

Silicon compounds containing halogen atom(s), that is, so-called silane derivatives substituted with halogen atom(s), are preferably silicon halides such as $SiF_4$, $Si_2F_6$, $SiCl_4$, $SiBr_4$, and the like.

In case that such a silicon compound containing halogen atom(s) is used for producing the photoconductive member of the present invention by glow discharge, there can be formed an amorphous layer composed of a-Si containing halogen atom on the support without using a silicon hydride gas for supplying Si.

Upon producing an amorphous layer containing halogen atom by glow discharge, a silicon halide gas for supplying Si and a gas such as Ar, $H_2$, He and the like are introduced into a deposition chamber for forming an amorphous layer at a predetermined mixing ratio and a predetermined gas flow rate to cause glow discharge and form a plasma atmosphere of these gases. As a result, an amorphous layer is formed on a predetermined support. In order to introduce hydrogen atoms into the amorphous layer, a predetermined amount of a gas of a silicon compound containing hydrogen atoms may be mixed with the abovementioned gases.

Each gas may be a single species or plural species at a predetermined mixing ratio.

For producing an amorphous layer comprising a-Si (H, X) by reactive sputtering or ion plating, an Si target is used and sputtering is effected in a predetermined gas plasma atmosphere in the case of sputtering while a polycrystalline silicon or a single crystalline silicon is placed in an evaporation boat as an evaporation source and the silicon evaporation source is heated and evaporated by resistive heating, electron beam (EB method) or the like to pass the evaporated flying matter through a predetermined gas plasma atmosphere in the case of ion plating.

For introducing halogen atoms into the layer to be formed in a sputtering method or an ion plating method the abovementioned halogen compound or the abovementioned silicon compound containing halogen atom(s) is introduced into a deposition chamber to form a plasma atmosphere of said gas.

For introducing hydrogen atoms, a starting gas for introducing hydrogen atoms such as $H_2$, the abovementioned silanes and the like into a deposition chamber for sputtering to form a plasma atmosphere of said gas.

Other than the abovementioned halogen compounds or silicon compounds containing halogen used as an effective starting gas for introducing halogen atoms, there may be used a gaseous or gasifiable halide containing hydrogen atom as a constituent element, for example, a hydrogen halide such as HF, HCl, HBr and HI, and a halogen-substituted silicon hydride such as $SiH_2F_2$, $SiH_2I_2$, $SiH_2Cl_2$, $SiHCl_3$, $SiH_2Br_2$, $SiHBr_3$ and the like, as a starting material for forming an amorphous layer.

These halides containing hydrogen atom(s) can introduce a hydrogen atom capable of effectively controlling electrical or photoelectric characteristics as well as a halogen atom into an amorphous layer and therefore, the halides are preferable starting materials for introducing halogen atoms.

For introducing a hydrogen atom constitutionally into an amorphous layer, other than the abovementioned material, a silicon hydride gas such as $SiH_4$, $Si_2H_6$, $Si_3H_8$, $Si_4H_{10}$, and the like and a silicon compound for supplying Si are introduced into a deposition chamber and discharge is caused.

For example, in the case of reaction sputtering, an Si target is used, and a gas for introducing a halogen atom, $H_2$ gas, and if desired, an inert gas such as He, Ar and the like are introduced into a deposition chamber to form a plasma atmosphere followed by sputtering with said Si target to produce an amorphous layer composed of a-Si (H, X) on a support.

Further, $B_2H_6$ or the like gas may be introduced for doping.

In the present invention, the amount of hydrogen atom (H), halogen atom (X), or the total amount of hydrogen atom and halogen atom contained in the amorphous layer of the photoconductive member is preferably 1–40 atomic %, more preferably 5–30 atomic %.

The amount of hydrogen atom (H) and/or halogen atom (X) contained in the amorphous layer may be controlled by controlling, for example, the support temperature and/or hydrogen atom (H), or the amount of the starting material for incorporating a halogen atom (X) to be introduced into a deposition chamber, or the discharge power or the like.

For forming the second layer region (III) containing a Group III atom or the first layer region (O) containing an oxygen atom in the amorphous layer, upon producing the amorphous layer by glow discharge, reactive sputtering or the like there may be used a starting material for introducing a Group III atom and a starting material for introducing oxygen atom together with the abovementioned starting material for forming the amorphous layer to incorporate the components in the layer to be formed under controlling the amounts.

When the first layer region (O) and the second layer region (III) in the amorphous layer are produced by glow discharge, the stating material of the starting gas for producing each layer region is prepared by combining the abovementioned starting material for producing the amorphous layer and a starting material for introducing oxygen atom and/or a starting material for introducing a Group III atom. As such a material for introducing oxygen atom and/or a Group III atom, there may be used most of the gaseous or gasified gasifiable material which contains oxygen atom or a Group III atom as a constituent atom.

For example, for producing the first layer region (O), there may be used a mixture at a desired ratio of a starting gas containing silicon atom (Si) as a constituent atom, a starting gas containing oxygen atom (O) as a constituent atom, and if desired, a starting gas containing hydrogen atom (H) and/or halogen atom (X) as constituent atoms; a mixture at desired ratio of a starting gas containing silicon atom (Si) as a constituent atom and a starting gas containing oxygen atom (O) and hydrogen atom (H) as constituent atoms; or a mixture of a starting gas containing silicon atom (Si) as a constituent atom and a starting gas containing silicon atom (Si), oxygen atom (O) and hydrogen atom (H) as constituent atoms.

Alternatively, there may be used a mixture of a starting gas containing silicon atom (Si) and hydrogen atom (H) as constituent atoms and a starting gas containing oxygen atom (O) as a constituent atom.

As a starting material for introducing oxygen atom, there may be mentioned oxygen ($O_2$), ozone ($O_3$), nitrogen monoxide (NO), nitrogen dioxide ($NO_2$), dinitrogen oxide ($N_2O$), dinitrogen trioxide ($N_2O_3$), dinitrogen tetraoxide ($N_2O_4$), dinitrogen pentoxide ($N_2O_5$), nitrogen trioxide ($NO_3$), lower siloxanes containing Si, O and H as constituent atoms such as disiloxane ($H_3SiOSiH_3$), trisiloxane ($H_3SiOSiH_2OSiH_3$), and the like.

As the starting material for introduction of the Group III atoms when forming the second layer region (III) by using a glow discharge method, there may be effectively employed, for introduction of boron atoms, boron hydrides such as $B_2H_6$, $B_4H_{10}$, $B_5H_9$, $B_5H_{11}$, $B_6H_{10}$, $B_6H_{12}$, $B_6H_{14}$, etc. and boron halides such as $BF_3$, $BCl_3$, $BBr_3$, etc. In addition, there may also be included $AlCl_3$, $GaCl_3$, $Ga(CH_3)_3$, $InCl_3$, $TlCl_3$, and the like.

The content of the Group III atoms to be introduced into the layer region (III) containing the Group III atoms may be controlled freely by controlling the gas flow rate and the gas flow rate ratio of the starting materials for introduction of the Group III atoms, the discharging power, the support temperature and the pressure within the deposition chamber.

For formation of the first layer region (O) containing oxygen atoms by the sputtering method, a single crystalline or polycrystalline Si wafer or $SiO_2$ wafer, or a wafer containing Si and $SiO_2$ mixed therein is used as target and sputtering is effected in an atmosphere of various gases.

For example, when Si wafer is used as target, a starting gas for introduction of oxygen atoms and, if necessary, hydrogen atoms and/or halogen atoms, which may be diluted with a diluting gas, if desired, is introduced into a deposition chamber for sputtering to form a gas plasma therein and effect sputtering of said Si wafer.

Alternatively, Si and $SiO_2$ as separate targets or one sheet target of a mixture of Si and $SiO_2$ can be used and sputtering is effected in a gas atmosphere containing at least hydrogen atoms (H) and/or halogen atoms (X) as constituent elements. As the starting gas for introduction of oxygen atoms, those as mentioned in the glow discharge as described above may be used as effective gases also in case of sputtering.

In the present invention, as the diluting gas to be employed in forming the amorphous layer according to the glow discharge method or the sputtering method, there may be included so called rare gases such as He, Ne, Ar and the like as suitable ones.

Figure 11:
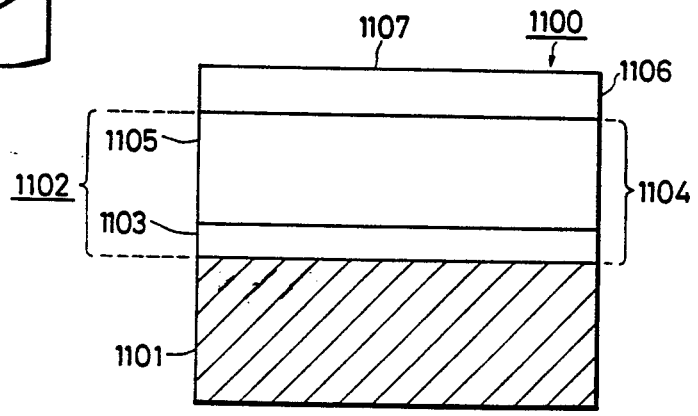

FIG. 11 schematically shows another preferable embodiment of the photoconductive member. A photoconductive member 1100 has a support 1101 for a photoconductive member, a first amorphous layer (I) 1102 containing a-Si (H, X) and having photoconductivity overlying the support 1101 and a second amorphous layer (II) 1106.

Photoconductive member 1100 has the same layer structure as the photoconductive member in FIG. 1 except that the second amorphous layer (II) 1106 is mounted on the first amorphous layer (I) 1102. The first amorphous layer (I) 1102 comprises a first layer region (O) 1103 containing oxygen atom as a constituent atom, a second layer region (III) 1104 containing a Group III atom as a constituent which is continuously distributed in the direction of the layer thickness and is enriched at the support 1101 side, and an upper layer region 1105. The constituting materials, preparation conditions and preparation procedures are the same as the amorphous layer 102 in FIG. 1.

In the upper layer region 1105, oxygen atoms are not containd, but only in the first layer region (O) 1103.

In the case of the photoconductive member 1100 in FIG. 11, the second amorphous layer (II) 1106 comprises an amorphous material composed of silicon atom, carbon atom, and if desired, at least one of hydrogen atom and halogen atom as constituent atoms (hereinafter referred to as "a-SiC(H, X)"), and has a free surface 1107.

The second amorphous layer (II) 1106 is provided primarily for the purpose of accomplishing the objects of the present invention with respect to humidity resistance, continuous repeated use characteristics, dielectric strength, environmental characteristics in use and durability.

In the photoconductive member 1100 as shown in FIG. 11, since each of the amorphous materials forming the first amorphous layer (I) 1102 and the second amorphous layer (II) 1106 have the common constituent of silicon atom, chemical and electric stabilities are sufficiently ensured at the laminated interface.

As a-SiC(H,X) constituting the second amorphous layer (II), there may be mentioned an amorphous material constituted of silicon atoms and carbon atoms ($a\text{-}Si_aC_{1-a}$, where $0<a<1$), an amorphous material constituted of silicon atoms, carbon atoms and hydrogen atoms ($a\text{-}(Si_bC_{1-b})_cH_{1-c}$ where $0<a$, $b<1$) and an amorphous material constituted of silicon atoms, carbon atoms, halogen atoms (X) and, if desired, hydrogen atoms ($a\text{-}Si_dC_{1-d})_e(X,H)_{1-e}$, where $0<d$, $e<1$) as effective materials.

Formation of the second amorphous layer (II) constituted of a-SiC(H,X) may be performed according to the glow discharge method, the sputtering method, the ion implantation method, the ion plating method, the electron beam method, etc. These preparation methods may be suitably selected depending on various factors such as the preparation conditions, the degree of the load for capital investment for installations, the production scale, the desirable characteristics required for the photoconductive member to be prepared, etc. For the advantages of relatively easy control of the preparation conditions for preparing photoconductive members having desired characteristics and easy introduction of silicon atoms together with carbon atoms, hydrogen atoms, and halogen atoms, into the second amorphous layer (II) to be prepared, there may preferably be employed the glow discharge method or the sputtering method.

Further, in the present invention, the second amorphous layer (II) may be formed by using the glow discharge method and the sputtering method in combination in the same device system.

For formation of the second amorphous layer (II) according to the glow discharge method, starting gases for formation of a-SiC(H,X), optionally mixed at a predetermined mixing ratio with a diluting gas, may be introduced into a deposition chamber for vacuum deposition in which a support is placed, and the gas introduced is made into a gas plasma by excitation of glow discharging, thereby depositing a-SiC(H,X) on the first amorphous layer (I) which has already been formed on the aforesaid support.

As the starting gases for formation of a-SiC(H,X) to be used in the present invention, it is possible to use most of gaseous substances or gasified gasifiable substances containing at least one of Si, C, H and X as constituent atoms.

In case that a starting gas having Si as constituent atoms as one of Si, C, H and X is employed, there may be employed, for example, a mixture of a starting gas containing Si as a constituent atom with a starting gas containing C as a constituent atom and a starting gas containing H or X as constituent atom at a desired mixing ratio, or alternatively a mixture of a starting gas containing Si as constituent atoms with a starting gas containing C and H or X also at a desired mixing ratio, or a mixture of a starting gas containing Si as constituent atoms with a gas containing three kinds of atoms, Si, C and H, or Si, C and X as constituent atoms.

Alternatively, it is also possible to use a mixture of a starting gas containing Si and H or X as constituent atoms with a starting gas containing C as constituent atom.

In the present invention, the starting gases effectively used for formation of the second amorphous layer (II) may include silicon halide gases containing Si and H as constituent atoms such as silanes (e.g. $SiH_4$, $Si_2H_6$, $Si_3H_8$, $Si_4H_{10}$, etc), compounds containing C and H as constituent atoms such as saturated hydrocarbons having 1 to 5 carbon atoms, ethylenic hydrocarbons having 2 to 5 carbon atoms and acetylenic hydrocarbons having 2 to 4 carbon atoms.

More specifically, there may be included, as saturated hydrocarbons, methane ($CH_4$), ethane ($C_2H_6$), propane ($C_3H_8$), n-butane (n-$C_4H_{10}$), pentane ($C_5H_{12}$); as ethylenic hydrocarbons, ethylene ($C_2H_4$), propylene ($C_3H_6$), butene-1 ($C_4H_8$), butene-2 ($C_4H_8$), isobutylene ($C_4H_8$), pentene ($C_5H_{10}$); as acetylenic hydrocarbons, acetylene ($C_2H_2$), methyl acetylene ($C_3H_4$), butyne ($C_4H_6$); and the like.

As the starting gas containing Si, C and H as constituent atoms, there may be mentioned alkyl silanes such as $Si(CH_3)_4$, $Si(C_2H_5)_4$ and the like. In addition to these starting gases, it is also possible as a matter of course to use $H_2$ as effective starting gas for introduction of H.

In the present invention, preferable halogen atoms (X) to be contained in the second amorphous layer (II) are F, Cl, Br and I. Particularly, F and Cl are preferred.

Incorporation of hydrogen atoms in the second amorphous layer (II) is convenient from the aspect of production cost, because a part of starting gas species can be made common in forming continuous layers together with the first amorphous layer (I).

In the present invention, as the starting gas which can be used effectively for introduction of halogen atoms (X) in formation of the second amorphous layer (II), there may be mentioned gaseous substances under conditions of normal temperature and normal pressure or readily gasifiable substances.

Such starting gases for introduction of halogen atoms (X) may include single halogen substances, hydrogen halides, interhalogen compound, silicon halides, halo-substituted hydrogenated silicons and the like.

More specifically, there may be mentioned, as single halogen substances, halogen gases such as of fluorine, chlorine, bromine and iodine; as hydrogen halides, HF, HI, HCl, HBr; as interhalogen compounds, BrF, ClF, $ClF_3$, $ClF_5$, $BrF_5$, $BrF_3$, $IF_7$, $IF_5$, ICl, IBr; as silicon halides, $SiF_4$, $Si_2F_6$, $SiCl_4$, $SiCl_3Br$, $SiCl_2Br_2$, $SiClBr_3$, $SiCl_3I$, $SiBr_4$; as halo-substituted hydrogenated silicon, $SiH_2F_2$, $SiH_2Cl_2$, $SiHCl_3$, $SiH_3Cl$, $SiH_3Br$, $SiH_2Br_2$, $SiHBr_3$, and so on.

In addition to these materials, there may also be employed halo-substituted parafinic hydrocarbons such as $CCl_4$, $CHF_3$, $CH_2F_2$, $CH_3F$, $CH_3Cl$, $CH_3Br$, $CH_3I$, $C_2H_2Cl$ and the like, fluorinated sulfur compounds such as $SF_4$, $SF_6$ and the like, halo-containing alkyl silanes such as $SiCl(CH_3)_3$, $SiCl_2(CH_3)_2$, $SiCl_3CH_3$ and the like, as effective materials.

For formation of the second amorphous layer (II), according to the sputtering method, a single crystalline or polycrystalline Si wafer or C wafer or a wafer containing Si and C mixed therein is used as target and subjected to sputtering in an atmosphere of various gases.

For example, when Si wafer is used as target, a starting gas for introducing at least C, which may be diluted with a diluting gas, if desired, is introduced into a deposition chamber for sputter to form a gas plasma therein and effect sputtering with said Si wafer.

Alternatively, Si and C as separate targets or one sheet target of a mixture of Si and C can be used and sputtering is effected in a gas atmosphere containing, if necessary, at least hydrogen atoms or halogen atoms.

As the starting gas for introduction of C or for introduction of H or X, there may be employed those as mentioned in the glow discharge as described above as effective gases also in case of the sputtering method.

In the present invention, as the diluting gas to be used in forming the second amorphous layer (II) by the glow discharge method or the sputtering method, there may be preferably employed so called rare gases such as He, Ne, Ar and the like.

The second amorphous layer (II) in the present invention should be carefully formed so that the required characteristics may be given exactly as desired.

That is, a substance containing as constituent atoms Si, C and, if necessary, H and/or X can take various forms from crystalline to amorphous, electrical properties from conductive through semi-conductive to insulating and photoconductive properties from photoconductive to non-photoconductive depending on the preparation conditions. Therefore, in the present invention, the preparation conditions are strictly selected as desired so that there may be formed a-SiC(H,X) having desired characteristics depending on the purpose.

For example, when the second amorphous layer (II) is to be provided primarily for the purpose of improvement of dielectric strength, a-SiC(H,X) is prepared as an amorphous material having marked electric insulating behaviours under the usage conditions.

Alternatively, when the primary purpose for provision of the second amorphous layer (II) is improvement of continuous repeated use characteristics or environmental characteristics in use, the degree of the above electric insulating property may be alleviated to some extent and a-SiC(H,X) may be prepared as an amorphous material having sensitivity to some extent to the light irradiated.

In forming the second amorphous layer (II) comprising a-SiC(H,X) on the surface of the first amorphous layer (I), the support temperature during layer formation is an important factor having influences on the structure and the characteristics of the layer to be formed, and it is desired in the present invention to control severely the support temperature during layer formation so that a-SiC(H,X) having intended characteristics may be prepared as desired.

As the support temperature in forming the second amorphous layer (II) for accomplishing effectively the objects of the present invention, there may be selected suitably the optimum temperature range in conformity with the method for forming the second amorphous layer (II) in carrying out formation of the second amorphous layer (II).

When the second amorphous layer (II) is to be formed of a-$Si_aC_{1-a}$, the support temperature may preferably be 20° to 300° C., more preferably 20° to 250° C.

When the second amorphous layer (II) is to be formed of a-$(Si_bC_{1-b})_cH_{1-c}$ or a-$(Si_dC_{1-d})_e(X,H)_{1-e}$, the support temperature may preferably be 50° to 350° C., more preferably 100° to 250° C.

For formation of the second amorphous layer (II), the glow discharge method or the sputtering method may be advantageously adopted, because severe control of the composition ratio of atoms constituting the layer or control of layer thickness can be conducted with relative ease as compared with other methods. In case when the second amorphous layer (II) is to be formed according to these layer forming methods, the discharging power and the gas pressure during layer formation are important factors influencing the characteristics of a-SiC(H,X) to be prepared, similarly as the aforesaid support temperature.

The discharging power condition for preparing effectively a-$Si_aC_{1-a}$ having characteristics for accomplishing the objects of the present invention with good productivity may preferably be 50 W to 250 W, most preferably 80 W to 150 W.

The discharging power conditions, in case of a-$(Si_bC_{1-b})_cH_{1-c}$ or a-$(Si_dC_{1-d})_e(X,H)_{1-e}$, may preferably be 10 to 300 W, more preferably 20 to 200 W.

The gas pressure in a deposition chamber may preferably be about 0.01 to 5 Torr, more preferably about 0.01 to 1 Torr, most preferably about 0.1 to 0.5 Torr.

In the present invention, the above numerical ranges may be mentioned as preferably numerical ranges for the support temperature, discharging power, etc. for preparation of the second amorphous layer (II). However, these factors for layer formation should not be determined separately independently of each other, but it is desirable that the optimum values of respective layer forming factors should be determined based on mutual organic relationships so that a second amorphous layer (II) comprising a-SiC(H,X) having desired characteristics may be formed.

The contents of carbon atoms and hydrogen atoms in the second amorphous layer (II) in the photoconductive member of the present invention are the second important factor for obtaining the desired characteristics to accomplish the objects of the present invention, similarly as the conditions for preparation of the second amorphous layer (II).

The content of carbon atoms contained in the second amorphous layer (II) in the present invention, when it is constituted of a-$Si_aC_{1-a}$, may be preferably $1\times10^{-3}$ to 90 atomic %, more preferably 1 to 80 atomic %, most preferably 10 to 75 atomic %. That is, in terms of the aforesaid representation a in the formula a-$Si_aC_{1-a}$, a may be preferably 0.1 to 0.99999, more preferably 0.2 to 0.99, most preferably 0.25 to 0.9.

When the second amorphous layer (II) is constituted of a-$(Si_bC_{1-b})_cH_{1-c}$, the content of carbon atoms contained in said layer (II) may be generally $1\times10^{-3}$ to 90 atomic %, preferably 1 to 90 atomic %, most preferably 10 to 80 atomic %. The content of hydrogen atoms may be generally 1 to 40 atomic %, preferably 2 to 35 atomic %, most preferably 5 to 30 atomic %. A photoconductive member formed to have a hydrogen atom content with these ranges is sufficiently applicable as an excellent one in practical applications. That is, in terms of the representation by a-$(Si_bC_{1-b})_cH_{1-c}$, b may be generally 0.1 to 0.99999, preferably 0.1 to 0.99, most preferably 0.15 to 0.9, and c generally 0.6 to 0.99, preferably 0.65 to 0.98, most preferably 0.7 to 0.95.

When the second amorphous layer (II) is constituted of a-$(Si_dC_{1-d})_e(X,H)_{1-e}$, the content of carbon atoms contained in said layer (II) may be generally $1\times10^{-3}$ to 90 atomic %, preferably 1 to 90 atomic %, most preferably 10 to 80 atomic %. The content of halogen atoms may be generally 1 to 20 atomic %, preferably 1 to 18 atomic %, most preferably 2 to 15 atomic %. A photoconductive member formed to have a halogen atom content with these ranges is sufficiently applicable as an excellent one in practical applications. The content of hydrogen atoms to be optionally contained may be generally up to 19 atomic %, preferably up to 13 atomic %. That is, in terms of the representation by a-$(Si_dC_{1-d})_e(X,H)_{1-e}$, d may be generally 0.1 to 0.99999, preferably 0.1 to 0.99, most preferably 0.15 to 0.9, and e generally 0.8 to 0.99, preferably 0.82 to 0.99, most preferably 0.85 to 0.98.

The range of the numerical value of layer thickness of the second amorphous layer (II) in the present invention is one of important factors for accomplishing effectively the objects of the present invention.

It is desirable that the range of the numerical value of layer thickness of the second amorphous layer (II) is suitably determined depending on the intended purpose so as to effectively accomplish the objects of the present invention.

The layer thickness of the second amorphous layer (II) is required to be determined as desired suitably with due considerations about the relationships with the contents or carbon atoms, hydrogen atoms or halogen atoms, the layer thickness of the first amorphous layer (I), as well as other organic relationships with the characteristics required for respective layer regions. In addition, it is also desirable to have considerations from economical point of view such as productivity or capability of mass production.

The second amorphous layer (II) in the present invention is desired to have a layer thickness generally of 0.003 to 30μ, preferably 0.004 to 20μ, most preferably 0.005 to 10μ.

An example of producing the photoconductive member by glow discharge is as explained below.

Figure 12:
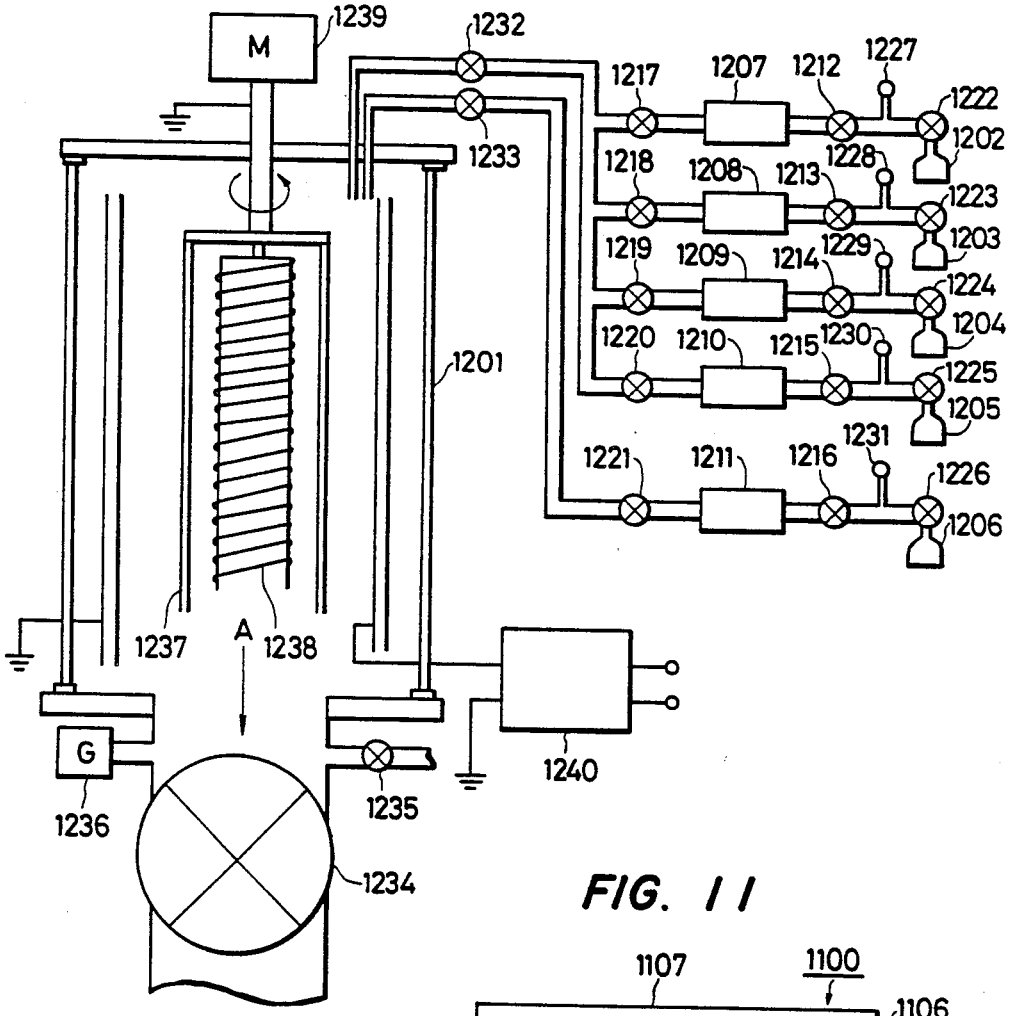
FIG. 12 and FIG. 13 schematically show apparatuses which may be used for preparing the photoconductive member according to the present invention.

FIG. 12 shows an apparatus for producing a photoconductive member by glow discharge.

In the gas bombs 1202–1206, there are hermetically contained starting gases for the formation of respective layers of the photoconductive member of the present invention. For example, 1202 is a bomb containing $SiH_4$ gas diluted with He (purity: 99.999%, hereinafter abbreviated as $SiH_4$/HE), 1203 is a bomb containing $B_2H_6$, gas diluted with He (purity: 99.999%, hereinafter abbreviated as $B_2H_6$/He), 1204 is a bomb containing $Si_2H_6$, gas diluted with He (purity: 99.99%, hereinafter abbreviated as $Si_2H_6$/He), 1205 is a bomb containing NO gas (purity: 99.999%), and 1206 is a bomb containing $SiF_4$ gas diluted with He (purity: 99.999%, hereinafter abbreviated as $SiF_4$/He).

For allowing these gases to flow into the reaction chamber 1201, on confirmation of the valves 1222–1226 of the gas bombs 1202–1206 and the leak valve 1235 to be closed, and the inflow valve 1212–1216, the outflow valves 1217–1221 and the auxiliary valves 1232, 1233 to be opened, the main valve 1234 is first opened to evacuate the reaction chamber 1201 and the gas pipelines. As the next step, when the reading on the vacuum indicator 1236 becomes about $5\times10^{-6}$ Torr, the auxiliary valves 1232 and 1233, and outflow valves 1217–1221 are closed.

An example for producing a photoconductive member having an amorphous layer of the layer structure as shown in FIG. 1 on a cylinder support 1237 is shown below.

$SiH_4$/He gas, $B_2H_6$/He gas and NO gas are introduced into mass-flow controllers 1207, 1208 and 1210 from gas bombs 1202, 1203 and 1205 by opening valves 1222, 1223, and 1225 to adjust the pressure of outlet pressure gauges 1226, 1228 and 1230 to 1 kg/cm$^2$ and gradually opening inflow valves 1212, 1213 and 1215. Then, outflow valves 1217, 1218 and 1220, and auxiliary valve 1232 are gradually opened and each gas is introduced into reaction chamber 1201.

At this time, outflow valves 1217, 1218, and 1220 are adjusted to make the flow rate ratio of $SiH_4$/He:$B_2H_6$/He:NO a predetermined value, and the opening of main valve 1234 is adjusted observing the reading of vacuum meter 1236 to make the pressure in reaction chamber 1201 a desired value. After confirming that the temperature of the support cylinder 1237 is set at a temperature of 50°–400° C. by a heater 1238, a power source 1240 is set to a desired power value to cause a glow discharge in reaction chamber 1201 simultaneously with controlling the concentration distribution in the layer thickness direction of boron atom contained in the layer to be formed by gradually changing the opening of valve 1218 according to a predetermined changing rate curve by manual means or external driving motor means etc.

At the point when the layer region (B, O) containing boron and oxygen atoms is formed in a desired layer thickness, the layer formation is continuously carried out under the same conditions except that outflow valve 1220 is closed and the introduction of NO gas into reaction chamber 1201 is stopped, and thereby there is formed a layer region (B) containing boron atom, but not oxygen atom on the layer region (B, O) in a desired thickness. As a result, there is formed an amorphous layer having desired characteristics on the support.

The second layer region (III) containing boron atom may be produced in a desired thickness by stopping the introduction of $B_2H_6$/He gas into reaction chamber 1201 at an appropriate time upon producing the amorphous layer, and there may be produced a layer region (III) occupying the whole layer region of the amorphous layer or a part thereof.

For layer region (B) is formed in a desired layer thickness in the above example, the layer formation is continuously carried out under the same conditions except that the introduction of $B_2H_6$/He gas into reaction chamber 1201 is stopped by completely closing outflow valve 1218, and thereby a layer region containing neither boron atom nor oxygen atom is formed on the layer region (B) as a part of the amorphous layer.

For producing a layer region containing oxygen atom, but not boron atom, the layer formation may be carried out, for example, by using NO gas and $SiH_4$/He gas.

For incorporating halogen atom in an amorphous layer, $SiF_4$/He may be added to the gas and introduced into reaction chamber 1201.

All the outflow valves other than those for gases necessary for formation of respective layers are, of course, closed, and during formation of respective layers, in order to avoid remaining of the gas used in the precedent layer in the reaction chamber 1201 and pipelines from the outflow valves 1217–1221 to the reaction chamber 1201, there may be conducted the procedure, comprising once evacuating to a high vacuum the system by closing the outflow valves 1217–1221 and opening the auxiliary valve 1232 and 1233 with full opening of the main valve 1234, if necessary.

During formation of the layer, the support cylinder 1237 may be rotated at a constant speed by means of a motor 1239 in order to effect a uniform layer formation.

Figure 13:
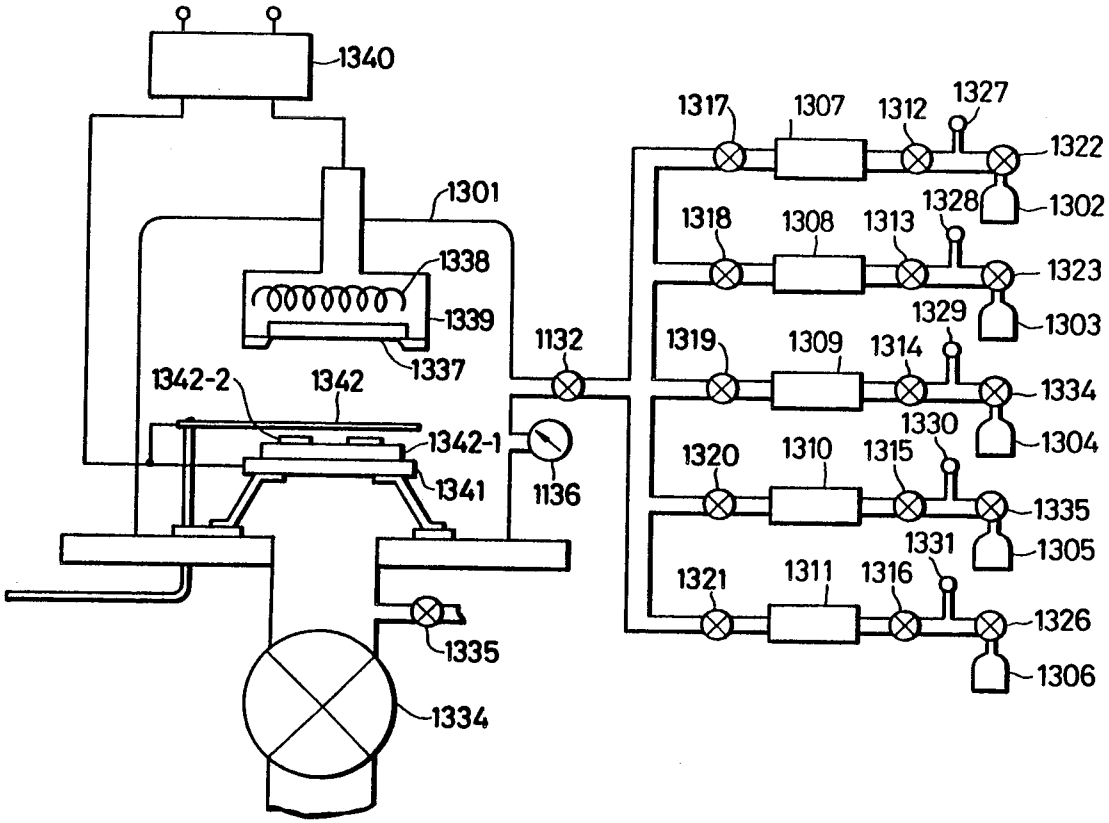

FIG. 13 shows an example of an apparatus for producing another photoconductive member.

In gas bombs 1302–1306, there are hermetically contained starting gases for producing respective layer regions of the photoconductive member of the present invention. For example, bomb 1302 contains $SiH_4$/He gas, bomb 1303 contains $B_2H_6$/He gas, bomb 1304 contains $Si_2H_6$/He gas, bomb 1305 contains NO gas, and bomb 1306 contains $SiF_4$/He gas.

For allowing these gases to flow into a reaction chamber 1301, after confirming that valves 1322–1326 of gas bombs 1302–1306 and a leak valve 1335 are closed and inflow valves 1312–1316, outflow valves 1317–1321, and an auxiliary valve 1332 are opened, a main valve 1334 is firstly opened to evacuate the reaction chamber 1301 and the gas pipelines. When the reading on a vacuum indicator 1336 becomes about $5\times10^{-6}$ Torr, auxiliary valve 1332 and outflow valves 1317–1321 are closed.

An embodiment of forming a photoconductive member having the layer structure as shown in FIG. 11 is shown below.

$SiH_4$/He gas from bomb 1302, $B_2H_6$/He gas from bomb 1303 and NO gas from bomb 1305 are permitted to flow into mass-flow controllers 1307, 1308 and 1310 by opening valves 1322, 1323 and 1325 to control outlet pressure gauges 1327, 1328 and 1330 to 1 kg/cm$^2$ and opening gradually inflow valves 1312, 1313 and 1315, respectively. Then, outflow valves 1317, 1318 and 1320 and auxiliary valve 1332 are gradually opened to permit the respective gases to flow into reaction chamber 1301. Outflow valves 1317, 1318 and 1320 are controlled so that the flow rate ratio of $SiH_4$/He gas:$B_2H_6$/He gas:NO gas may have a desired value, and opening of main valve 1334 is also controlled watching the reading of vacuum indicator 1336 so that the pressure in the reaction chamber may reach a desired value. Then, after confirming that the temperature of substrate 1337 is 50°–400° C. by a heater 1338, a power source 1340 is set at a desired power to cause glow discharge in reaction chamber 1301, and simultaneously the concentration distribution in the layer thickness direction of boron atom contained in the layer to be formed is controlled by gradually changing the opening of valve 1318 according to a predetermined changing rate curve by manual means or external driving motor means etc.

At the point when the layer region (B, O) containing boron and oxygen atoms is formed in a desired layer thickness, the layer formation is continuously carried out under the same conditions except that outflow valve 1320 is closed and the introduction of NO gas into reaction chamber 1301 is stopped, and thereby there is formed a layer region (B) containing boron atom, but not oxygen atom on the layer region (B, O) in a desired thickness. As a result, there is formed a first amorphous layer (I) having desired characteristics on the support.

The layer region (III) containing boron atom may be produced in a desired thickness by stopping the introduction of $B_2H_6$/He gas into reaction chamber 1301 at an appropriate time upon producing the first amorphous layer (I), and there may be produced a layer region (III) occupying the whole layer region of the first amorphous layer (I) or a part thereof.

For example, at a point when the layer region (B) is formed in a desired layer thickness in the above example, the layer formation is continuously carried out under the same conditions except that the introduction of $B_2H_6$/He gas into reaction chamber 1301 is stopped by completely closing outflow valve 1318, and thereby a layer region containing neither boron atom nor oxygen atom is formed on the layer region (B) as a part of the first amorphous layer (I).

For producing a layer region containing oxygen atom, but not boron atom, the layer formation may be carried out, for example, by using NO gas and $SiH_4$/He gas.

For incorporating halogen atom in a first amorphous layer (I), $SiF_4$, /He may be added to the gas and introduced into reaction chamber 1301.

For producing a second amorphous layer (II) on the first amorphous layer (I), for example, the following procedure is carried out. Firstly a shutter 1342 is opened, and all gas feeding valves are once closed and reaction chamber 1301 is evacuated by fully opening main valve 1334.

A high purity silicon wafer 1342-1 and a high purity graphite wafer 1342-2 are placed as targets on an electrode 1341 to which a high voltage power is applied, at a desired area ratio. Ar gas is introduced into reaction chamber 1301 from gas bomb 1306 which is preliminarily charged with Ar gas in place of $SiF_4$/He gas, and main valve 1334 is controlled so that the inner pressure of reaction chamber 1301 may become 0.05–1 Torr. High voltage power source 1340 is switched on to effect sputtering by using said targets resulting in the formation of a second amorphous layer (II) on the first amorphous layer (I).

The content of carbon atom in the second amorphous layer (II) may be optionally controlled by adjusting the area ratio of silicon wafer 1342-1 to graphite wafer 1342-2 and the weight ratio of silicon powder to graphite powder in the target.

All the outflow valves other than those for gases necessary for formation of respective layers are, of course, closed, and during formation of respective layers, in order to avoid remaining of the gas used in the precedent layer in reaction chamber 1301 and pipelines from outflow valves 1317–1321 to reaction chamber 1301, there may be conducted the procedure comprising once evacuating the system to a high vaccum by closing outflow valves 1317–1321 and opening auxiliary valve 1332 with full opening of main valve 1334, if necessary.

In view of the foregoing, the photoconductive member according to the present invention can solve all the abovementioned problems, and shows excellent electric, optical and photoconductive characteristics, high dielectric strength and excellent use environmental characteristics.

In particular, when the photoconductive member according to the present invention is used as an electrophotographic image forming member, the electrophotographic image forming member is free from residual potentials upon forming images, and has stable electric characteristics, high sensitivity, high SN ratio, high light fatigue resistance, and excellent repeated use characteristics. There can be repeatedly and stably produced images of high density, clear half-tone, high resolution and high quality.

EXAMPLE 1

Figure 14:
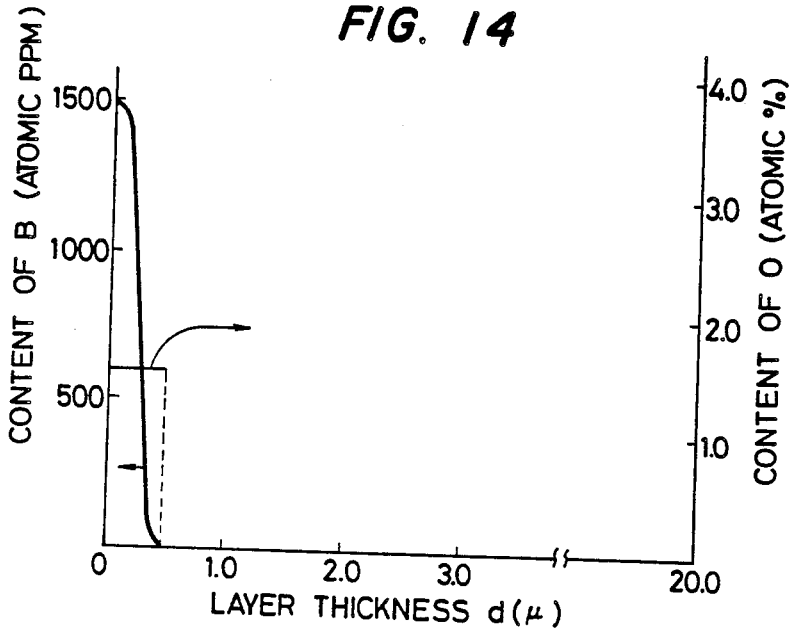
FIG. 14–FIG. 22 show the distributions of boron atom and oxygen atom in embodiments of the present invention.

By using the apparatus in FIG. 12, an image forming member having an amorphous layer of the concentration distribution of B and O as shown in FIG. 14 was produced under the conditions of Table 1A.

The resulting image forming member was set in a charging-exposing-developing device, and subjected to corona charging at ⊕5 KV for 0.2 sec followed by imagewise exposure immediately at 1.0 lux. sec through a transparent test chart with a tungsten lamp as a light source.

Immediately thereafter, the surface of the member was subjected to cascading of a ⊖ charged developer (including toner and carrier) to produce good toner images on the surface of the member.

EXAMPLE 2

Figure 15:
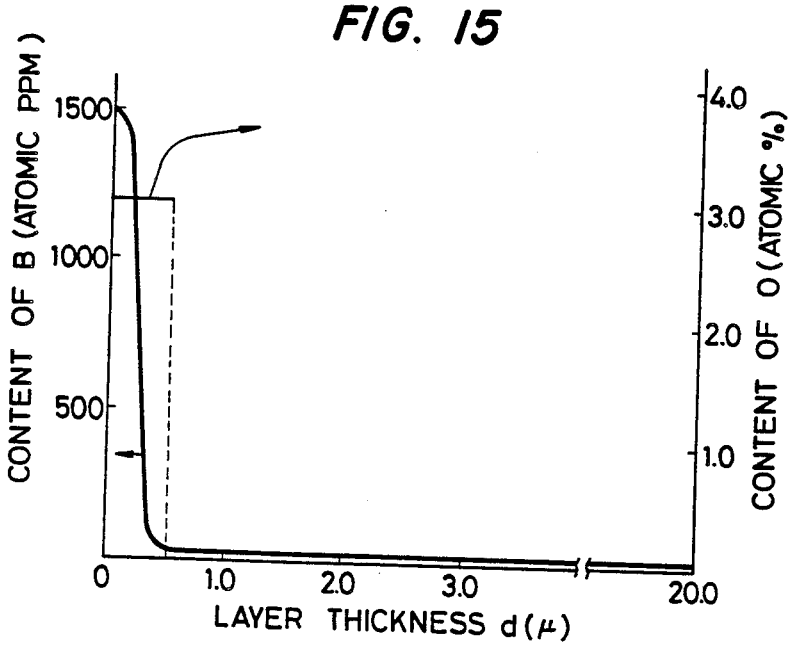

By using the apparatus in FIG. 12, an image forming member having an amorphous layer of the construction distribution of B and O as shown in FIG. 15 was produced under the conditons of Table 2A.

The resulting image forming member was set in a charging-exposing-developing device, and subjected to corona charging at ⊕5 KV for 0.2 sec followed by imagewise exposure immediately at 1.0 lux. sec through a transparent test chart with a tungsten lamp as a light source.

Immediately thereafter, the surface of the member was subjected to cascading of a ⊖ charged developer (including toner and carrier) to produce good toner images on the surface of the member.

EXAMPLE 3

By changing the flow rate of $B_2H_6$, there were produced image forming members having amorphous layers which had concentration distributions of boron as shown in FIG. 16–FIG. 21. The other conditions and evaluation were the same as those of Example 1. The results are shown in Table 3A.

EXAMPLE 4

By repeating the procedures of Example 1 except that the content of oxygen was changed by changing the flow rate of NO, image forming members were produced and evaluated as in Example 1. The results are shown in Table 4A.

EXAMPLE 5

By repeating the procedures of Example 2 except that the total thickness of the amorphous layer was 20 μm and the thickness of the first layer was changed, image forming members were produced and evaluated as in Example 2. The results are as shown in Table 5A.

EXAMPLE 6

By repeating the procedures in Example 1 except that the layer formation was carried out according to Table 6A, the resulting image forming member exhibited good results.

EXAMPLE 7

By using the apparatus in FIG. 13, an image forming member having an amorphous layer (I) having the concentration distribution of boron atom (B) and oxygen atom (O) as shown in FIG. 14 was produced under the conditions of Table 1B.

The resulting image forming member was set in a charging-exposing-developing device, and subjected to corona charging at ⊕5 KV for 0.2 sec followed immediately by imagewise exposure at 1.0 lux. sec through a transparent test chart with a tungsten lamp as a light source.

Immediately thereafter, the surface of the member was subjected to cascading of a ⊕ charged developer (including toner and carrier) to produce good toner images on the surface of the member.

The resulting toner images were once cleaned with a rubber blade, and then the abovementioned image forming and cleaning steps were repeated. Even when repeated 150,000 times or more, degradation of images was not observed.

EXAMPLE 8

By using the apparatus in FIG. 13, an image forming member having an amorphous layer (I) having the concentration distribution of boron atom (B) and oxygen atom (O) as shown in FIG. 15 was produced under the conditions of Table 2B.

The resulting image forming member was set in a charging-exposing-developing device, and subjected to corona charging ⊕5 KV for 0.2 sec followed immediately by imagewise exposure at 1.0 lux. sec through a transparent test chart with a tungsten lamp as a light source.

Immediately thereafter, the surface of the member was subjected to cascading of a ⊖ charged developer (including toner and carrier) to produce good toner images on the surface of the member.

The resulting toner images were once cleaned with a rubber blade, and then the abovementioned image forming and cleaning steps were reported. Even when repeated 150,000 times or more, degradation of images was not observed.

EXAMPLE 9

Figure 22:
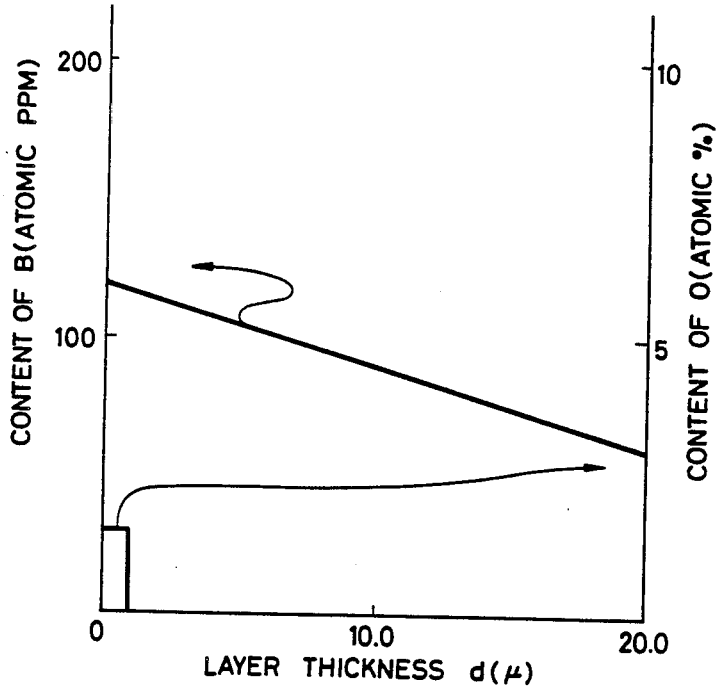

By using the apparatus in FIG. 13, an image forming member having an amorphous layer (I) having the concentration distribution of boron atom (B) and oxygen atom (O) as shown in FIG. 22 was produced under the conditions of Table 3B.

The resulting image forming member was set in a charging-exposing-developing device, and subjected to corona charging at ⊕5 KV for 0.2 sec followed immediately by imagewise exposure at 1.0 lux. sec through a transparent test chart with a tungsten lamp as a light source.

Immediately thereafter, the surface of the member was subjected to cascading of a ⊖-charged developer (including toner and carrier) to produce good toner images on the surface of the member.

The resulting toner images were once cleaned with a rubber blade, and then the abovementioned image forming and cleaning steps were repeated. Even when repeated 150,000 times or more, degradation of images was not observed.

EXAMPLE 10

By changing the flow rate of $B_2H_6$, there were produced image forming members having amorphous layer (I) which had concentration distribution of boron as shown in FIG. 16–FIG. 21. The other conditions and evaluation were the same as those in Example 7.

The results are shown in Table 4B.

EXAMPLE 11

By repeating the procedures in Example 7 except that the flow rate of NO was changed to change the content of oxygen in the amorphous layer (I), there was produced an image forming member and the evaluation was effected as in Example 7. The results are shown in Table 5B.

EXAMPLE 12

Repeating the procedure of Example 8 except that the thickness of the amorphous layer (I) was 20μ and the thickness of the first layer region was changed, there was produced an image forming member and the same evaluation as in Example 8 was effected.

The results are shown in Table 6B.

EXAMPLE 13

Repeating the procedure of Example 7 except that, upon forming the amorphous layer (II), the area ratio of silicon wafer to graphite was changed to change the content ratio of silicon atom to carbon atom in the amorphous layer (II), there was formed an image forming member. The resulting image forming member was subjected to the image forming, developing and cleaning steps about 50,000 times as in Example 7 and image evaluation was effected. The results are shown in Table 7B.

EXAMPLE 14

By repeating the procedure of Example 7 except that the layer thickness of the amorphous layer (II) was changed, there was formed an image forming member. The image forming, developing and cleaning steps were repeated as in Example 7. The results are shown in Table 8B.

EXAMPLE 15

By repeating the procedure of Example 7 except that the method of preparing the amorphous layer (I) was changed as in Table 9B, the layer formation was effected. Good result was obtained.

EXAMPLE 16

By using the apparatus in FIG. 13, an image forming member having an amorphous layer (I) having the concentration distribution of boron atom (B) and oxygen atom (O) as shown in FIG. 14 was produced under the conditions of Table 1C.

The resulting image forming member was set in a charging-exposing-developing device, and subjected to corona charging at ⊕5 KV for 0.2 sec followed immediately by imagewise exposure at 1.0 lux. sec through a transparent test chart with a tungsten lamp as a light source.

Immediately thereafter, the surface of the member was subjected to cascading of a ⊖ charged developer (including toner and carrier) to produce good toner images on the surface of the member.

The resulting toner images were once cleaned with a rubber blade, and then the abovementioned image forming and cleaning steps were reported. Even when repeated 150,000 times or more, degradation of images was not observed.

EXAMPLE 17

By using the apparatus in FIG. 13, an image forming member having an amorphous layer (I) having the concentration distribution of boron atom (B) and oxygen atom (O) as shown in FIG. 15 was produced under the conditions of Table 2C.

The resulting image forming member was set in a charging-exposing-developing device, and subjected to corona charging at ⊕5 KV for 0.2 sec followed immediately by imagewise exposure to 1.0 lux. sec through a transparent test chart with a tungsten lamp as a light source.

Immediately thereafter, the surface of the member was subjected to cascading of a ⊖-charged developer (including toner and carrier) to produce good toner images on the surface of the member.

The resulting toner images were once cleaned with a rubber blade, and then the abovementioned image forming and cleaning steps were reported. Even when repeated 150,000 times or more, degradation of images was not observed.

EXAMPLE 18

By using the apparatus in FIG. 13, an image forming member having an amorphous layer (I) having the concentration distribution of boron atom (B) and oxygen atom (O) as shown in FIG. 22 was produced under the conditions of Table 3C.

The resulting image forming member was set in a charging-exposing-developing device, and subjected to corona charging at ⊕5 KV for 0.2 sec followed immediately by imagewise exposure at 1.0 lux. sec through a transparent test chart with a tungsten lamp as a light source.

Immediately thereafter, the surface of the member was subjected to cascading of a ⊖-charged developer (including toner and carrier) to produce good toner images on the surface of the member.

The resulting toner images were once cleaned with a rubber blade, and then the abovementioned image forming and cleaning steps were repeated. Even when repeated 150,000 times or more, degradation of images was not observed.

EXAMPLE 19

By repeating the procedure of Example 16 except that the flow rate of $B_2H_6$ was changed, there were formed image forming members having the concentration distribution of boron in the amorphous layer (I) as shown in FIG. 16 to FIG. 21. Evaluation was effected as in Example 16.

The results are shown in Table 4C.

EXAMPLE 20

By repeating the procedure of Example 17 except that the flow rate of NO was changed to change the oxygen content in the amorphous layer (I), there were formed image forming members and evaluation was effected as in Example 17. The results are shown in Table 5C.

EXAMPLE 21

By repeating the procedure of Example 18 except that the thickness of the amorphous layer (I) was 20μ and the thickness of the first layer region was changed, there were produced image forming members and the same evaluation as in Example 18 was effected. The results are as shown in Table 6C.

EXAMPLE 22

By repeating the procedures of Example 17 except that, upon producing the amorphous layer (II), the flow rate ratio of $SiH_4$ gas to $C_2H_4$ gas was changed to change the content ratio of silicon atom to carbon atom in the amorphous layer (II), an image forming member was produced and subjected to the image forming step as in Example 17 up to transferring step. The copying was repeated about 50,000 times and image evaluation was effected.

The results are shown in Table 7C.

EXAMPLE 23

By repeating the procedure of Example 17 except that the layer thickness of the amorphous layer (II) was changed as in Table 8, the layer uniform was effected. The results of evaluation are shown in Table 8.

EXAMPLE 24

By repeating the procedure of Example 17 except that the method of forming the amorphous layer (I) was changed as in Table 9C, the layer formation was effected and evaluation was effected. Good result was obtained.

EXAMPLE 25

By using the apparatus in FIG. 13, an image forming member having an amorphous layer (I) having the concentration distribution of boron atom (B) and oxygen atom (O) as shown in FIG. 14 was produced under the conditions of Table 1D.

The resulting image forming member was set in a charging-exposing-developing device, and subjected to corona charging at ⊕5 KV for 0.2 sec followed immediately by imagewise exposure at 1.0 lux. sec through a transparent test chart with a tungsten lamp as a light source.

Immediately thereafter, the surface of the member was subjected to cascading of a ⊖ charged developer (including toner and carrier) to produce good toner images on the surface of the member.

The resulting toner images were once cleaned with a rubber blade, and then the abovementioned image forming and cleaning steps were repeated. Even when repeated 150,000 times or more, degradation of images was not observed.

EXAMPLE 26

By using the apparatus in FIG. 13, an image forming member having an amorphous layer (I) having the concentration distribution of boron atom (B) and oxygen atom (O) as shown in FIG. 15 was produced under the conditions of Table 2D.

The resulting image forming member was set in a charging-exposing-developing device, and subjected to corona charging at ⊕5 KV for 0.2 sec followed immediately by imagewise exposure at 1.0 lux. sec through a transparent test chart with a tungsten lamp as a light source.

Immediately thereafter, the surface of the member was subjected to cascading of a ⊖ charged developer (including toner and carrier) to produce good toner images on the surface of the member.

The resulting toner images were once cleaned with a rubber blade, and then the abovementioned image forming and cleaning steps were repeated. Even when repeated 150,000 times or more, degradation of images was not observed.

EXAMPLE 27

By using the apparatus in FIG. 13, an image forming member having an amorphous layer (I) having the concentration distribution of boron atom (B) and oxygen atom (O) as shown in FIG. 22 was produced under the conditions of Table 3D.

The resulting image forming member was set in a charging-exposing-developing device, and subjected to corona charging at ⊕5 KV for 0.2 sec followed immediately by imagewise expsoure at 1.0 lux. sec through a transparent test chart with a tungsten lamp as a light source.

Immediately thereafter, the surface of the member was subjected to cascading of a ⊖ charged developer (including toner and carrier) to produce good toner images on the surface of the member.

The resulting toner images were once cleaned with a rubber blade, and then the abovementioned image forming and cleaning steps were repeated. Even when repeated 150,000 times or more, degradation of images was not observed.

EXAMPLE 28

By repeating the procedure of Example 25 except that the flow rate of $B_2H_6$ was changed to form the concentration distribution of boron in the amorphous layer (I) as shown in FIG. 16–FIG. 21, there were produced image forming members. Evaluation was effected as in Example 25.

The results are shown in Table 4D.

EXAMPLE 29

By repeating the procedure of Example 25 except that the flow rate of NO was changed to change the oxygen content in the amorphous layer (I), there were produced image forming members and evaluated as in Example 25. The results are shown in Table 5D.

duced an image forming member. The evaluation showed a good result.

TABLE 1A

| | Gas employed | Flow Rate (SCCM) | Flow rate ratio | Discharge power (W/cm$^2$) | Layer deposition rate (Å/sec) | Layer Thickness (μ) |
|---|---|---|---|---|---|---|
| First Layer | $SiH_4$/He = 1<br>NO<br>$B_2H_6$/He = $10^{-3}$ | $SiH_4$ = 200 | NO/$SiH_4$ = $1.5 \times 10^{-2}$<br>$B_2H_6$/$SiH_4$ = $2.0 \times 10^{-4} \sim 0$ | 0.18 | 11 | 0.5 |
| Second Layer | $SiH_4$/He = 1 | $SiH_4$ = 200 | | 0.18 | 11 | 19.5 |

Al support temperature: 250° C.
Discharge frequency: 13.56 MHz
Inner pressure of reaction chamber: 0.3 Torr

TABLE 2A

| | Gas employed | Flow Rate (SCCM) | Flow rate ratio | Discharge power (W/cm$^2$) | Layer deposition rate (Å/sec) | Layer Thickness (μ) |
|---|---|---|---|---|---|---|
| First Layer | $SiH_4$/He = 1<br>NO<br>$B_2H_6$/He = $10^{-3}$ | $SiH_4$ = 200 | NO/$SiH_4$ = $1.5 \times 10^{-2}$<br>$B_2H_6$/$SiH_4$ = $2.0 \times 10^{-4} \sim 2.5 \times 10^{-5}$ | 0.18 | 11 | 0.5 |
| Second Layer | $SiH_4$/He = 1<br>$B_2H_6$/He = $10^{-3}$ | $SiH_4$ = 200 | $B_2H_6$/$SiH_4$ = $2.5 \times 10^{-5}$ | 0.18 | 11 | 19.5 |

Al support temperature: 250° C.
Discharge frequency: 13.56 MHz
Inner pressure of reaction chamber: 0.3 Torr

EXAMPLE 30

By repeating the procedure of Example 26 except that the thickness of the amorphous layer (I) was 20μ and the thickness of the first layer region was changed, there were produced image forming members and the same evaluation as in Example 26 was effected.

The results are shown in Table 6D.

TABLE 3A

Figure 16:
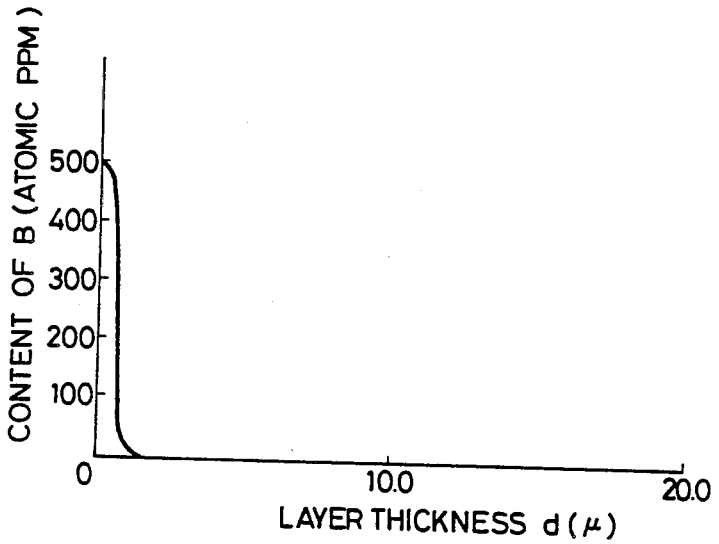
Figure 17:
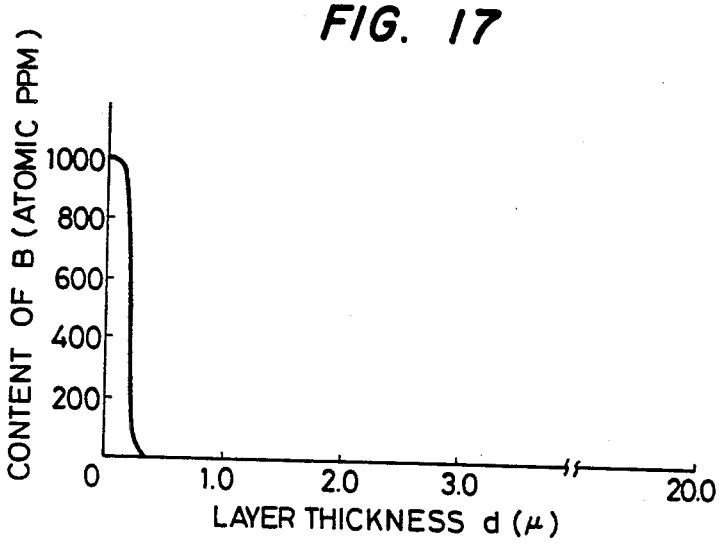
Figure 18:
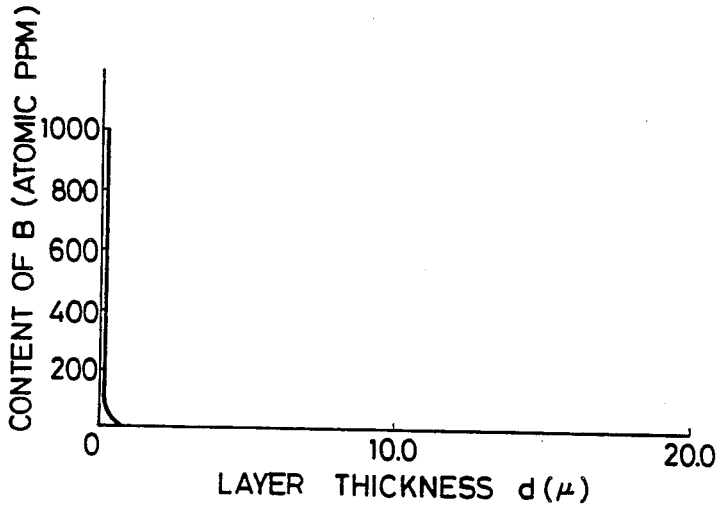
Figure 19:
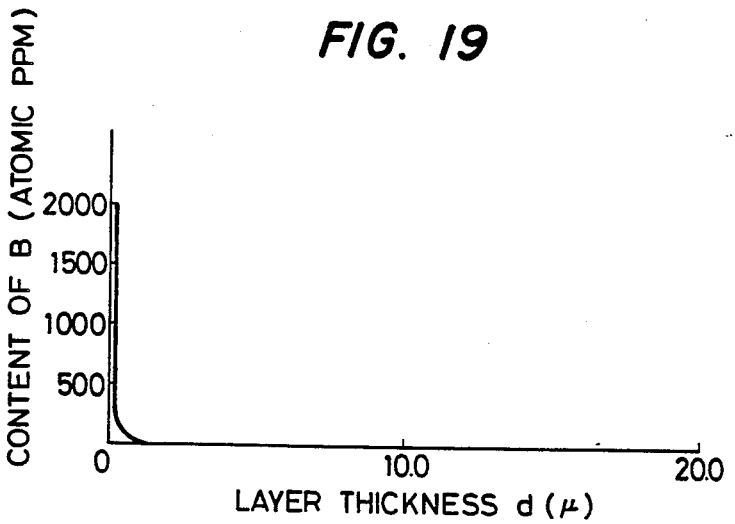
Figure 20:
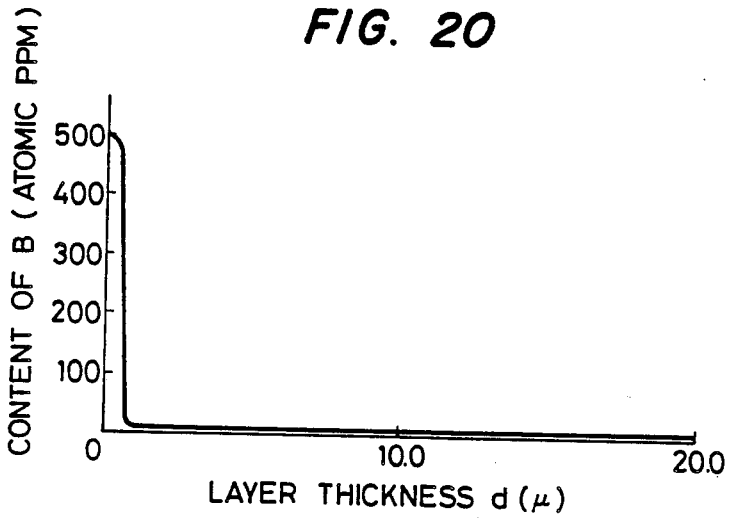
Figure 21:
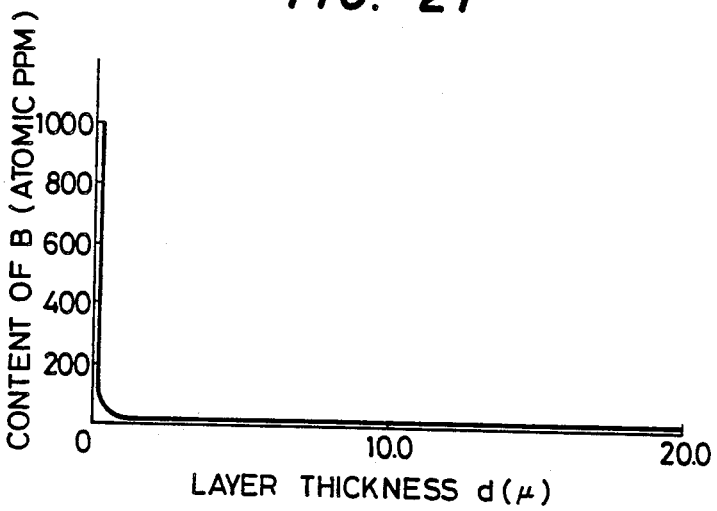

| Sample No. | A3-1 | A3-2 | A3-3 | A3-4 | A3-5 | A3-6 |
|---|---|---|---|---|---|---|
| Distribution figure | FIG. 16 | FIG. 17 | FIG. 18 | FIG. 19 | FIG. 20 | FIG. 21 |
| Evaluation | ◎ | ○ | ◎ | ◎ | ◎ | ◎ |

◎ No defective image; high image quality
○ No defective image; very good adhesion

EXAMPLE 31

By repeating the procedure of Example 25 except that, upon forming the amorphous layer (II), the flow rate ratio of $SiH_4$ gas:$SiF_4$ gas:$C_2H_4$ gas was changed to change the content ratio of silicon atom to carbon atom, an image forming member was produced, and subjected to the image forming, developing and cleaning steps as in Example 25 about 50,000 times. The results of image evaluation are shown in Table 7D.

TABLE 4A

| Sample No. | A4-1 | A4-2 | A4-3 | A4-4 | A4-5 | A4-6 | A4-7 |
|---|---|---|---|---|---|---|---|
| Oxygen Content (atomic %) | 0.003 | 0.05 | 0.5 | 1.0 | 3.0 | 5.0 | 10.0 |
| Evaluation | ○ | ○ | ◎ | ◎ | ◎ | ◎ | ○ |

◎ Very good
○ Good

EXAMPLE 32

By repeating the procedure of Example 25 except that the thickness of the amorphous layer (II) was changed, there was produced an image forming member. The resulting image forming member was subjected to the image forming, developing and cleaning steps as in Example 25 repeatedly. The results are shown in Table 8D.

TABLE 5A

| Sample No. | A5-1 | A5-2 | A5-3 | A5-4 | A5-5 | A5-6 | A5-7 | A5-8 |
|---|---|---|---|---|---|---|---|---|
| Thickness of first layer region (μ) | 0.05 | 0.1 | 0.3 | 0.8 | 1.5 | 3 | 7 | 10 |
| Evaluation | ○ | ◎ | ◎ | ◎ | ◎ | ○ | ○ | ○ |

◎ Very good
○ Good

EXAMPLE 33

By repeating the procedure of Example 25 except that the layer formation method of the amorphous layer (I) was changed as shown in Table 9D, there was pro-

TABLE 6A

| | Gas employed | Flow Rate (SCCM) | Flow rate ratio | Discharge power (W/cm$^2$) | Layer deposition rate (Å/sec) | Layer Thickness (μ) |
|---|---|---|---|---|---|---|
| First Layer | $SiH_4$/He = 1<br>$SiF_4$/He = 1<br>NO<br>$B_2H_6$/He = $10^{-3}$ | $SiH_4$ = 100 | NO/$SiH_4$ = $1.5 \times 10^{-2}$<br>$B_2H_6$/$SiH_4$/$SiF_4$ = $2.0 \times 10^{-4}$/0.5/0.5 ~ 0/0.5/0.5 | 0.18 | 15 | 0.5 |
| Second | $SiH_4$/He = 1 | $SiH_4$ = | $SiH_4$/$SiF_4$ = 1 | 0.18 | 11 | 19.5 |

TABLE 6A-continued

| | Gas employed | Flow Rate (SCCM) | Flow rate ratio | Discharge power (W/cm²) | Layer deposition rate (Å/sec) | Layer Thickness (μ) |
|---|---|---|---|---|---|---|
| Layer | $SiF_4/He = 1$ | 100 | | | | |

TABLE 1B

| Layer constitution | | Gas employed | Flow rate (SCCM) | Flow rate ratio | Discharge power (W/cm²) | Layer deposition rate (Å/sec) | Layer thickness (μ) |
|---|---|---|---|---|---|---|---|
| Amorphous layer (I) | First layer region | $SiH_4/He = 1$<br>NO<br>$B_2H_6/He = 10^{-3}$ | $SiH_4 = 200$ | $NO/SiH_4 = 1.5 \times 10^{-2}$<br>$B_2H_6/SiH_4 = 2.0 \times 10^{-4} \sim 0$ | 0.18 | 11 | 0.5 |
| | Second layer region | $SiH_4/He = 1$ | $SiH_4 = 200$ | | 0.18 | 11 | 19.5 |
| Amorphous layer (II) | | Ar | Ar = 200 | Area ratio<br>Si wafer:Graphite = 1.5:8.5 | 0.3 | 3 | 0.5 |

Al support temperature: 250° C.
Discharge frequency: 13.56 MHz
Inner pressure of reaction chamber: Amorphous layer (I) 0.3 Torr
Amorphous layer (II) 0.2 Torr

TABLE 2B

| Layer constitution | | Gas employed | Flow rate (SCCM) | Flow rate ratio | Discharge power (W/cm²) | Layer deposition rate (Å/sec) | Layer thickness (μ) |
|---|---|---|---|---|---|---|---|
| Amorphous layer (I) | First layer region | $SiH_4/He = 1$<br>NO<br>$B_2H_6/He = 10^{-3}$ | $SiH_4 = 200$ | $NO/SiH_4 = 1.5 \times 10^{-2}$<br>$B_2H_6/SiH_4 = 2.0 \times 10^{-4} \sim 2.5 \times 10^{-5}$ | 0.18 | 11 | 0.5 |
| | Second layer region | $SiH_4/He = 1$<br>$B_2H_6/He = 10^{-3}$ | $SiH_4 = 200$ | $B_2H_6/SiH_4 = 2.5 \times 10^{-5}$ | 0.18 | 11 | 19.5 |
| Amorphous layer (II) | | Ar | Ar = 200 | Area ratio<br>Si wafer:Graphite = 1.5:8.5 | 0.3 | 3 | 0.5 |

Al support temperature: 250° C.
Discharge frequency: 13.56 MHz
Inner pressure of reaction chamber: Amorphous layer (I) 0.3 Torr
Amorphous layer (II) 0.2 Torr

TABLE 3B

| Layer constitution | | Gas employed | Flow rate (SCCM) | Flow rate ratio | Discharge power (W/cm²) | Layer deposition rate (Å/sec) | Layer thickness (μ) |
|---|---|---|---|---|---|---|---|
| Amorphous layer (I) | First layer region | $SiH_4/He = 1$<br>NO<br>$B_2H_6/He = 10^{-3}$ | $SiH_4 = 200$ | $NO/SiH_4 = 1.5 \times 10^{-2}$<br>$B_2H_6/SiH_4 = 1.5 \times 10^{-4} \sim 7 \times 10^{-5}$ | 0.18 | 11 | 1.0 |
| | Second layer region | $SiH_4/He = 1$<br>$B_2H_6/He = 10^{-3}$ | $SiH_4 = 200$ | $B_2H_6/SiH_4 = 7 \times 10^{-5} \sim 6.5 \times 10^{-5}$ | 0.18 | 11 | 19.0 |
| Amorphous layer (II) | | Ar | Ar = 200 | Area ratio<br>Si wafer:Graphite = 1.5:8.5 | 0.3 | 3 | 0.5 |

Al support temperature: 250° C.
Discharge frequency: 13.56 MHz
Inner pressure of reaction chamber: Amorphous layer (I) 0.3 Torr
Amorphous layer (II) 0.2 Torr

TABLE 4B

| Sample No. | B4-1 | B4-2 | B4-3 | B4-4 | B4-5 | B4-6 |
|---|---|---|---|---|---|---|
| Distribution figure | FIG. 16 | FIG. 17 | FIG. 18 | FIG. 19 | FIG. 20 | FIG. 21 |
| Evaluation | ○ | ○ | ◎ | ◎ | ◎ | ◎ |

◎No defective image; high image quality
○ No defective image; very good adhesion TABLE 5B-continued

| Sample No. | B5-1 | B5-2 | B5-3 | B5-4 | B5-5 | B5-6 | B5-7 |
|---|---|---|---|---|---|---|---|
| Content (atomic %) | | | | | | | |
| Evaluation | ○ | ○ | ◎ | ◎ | ◎ | ◎ | ○ |

◎Very good
○ Good

TABLE 5B

| Sample No. | B5-1 | B5-2 | B5-3 | B5-4 | B5-5 | B5-6 | B5-7 |
|---|---|---|---|---|---|---|---|
| Oxygen | 0.003 | 0.05 | 0.5 | 1.0 | 3.0 | 5.0 | 10.0 |

TABLE 6B

| Sample No. | B6-1 | B6-2 | B6-3 | B6-4 | B6-5 | B6-6 | B6-7 | B6-8 |
|---|---|---|---|---|---|---|---|---|
| Thickness | 0.05 | 0.1 | 0.3 | 0.8 | 1.5 | 3 | 7 | 10 |

TABLE 6B-continued

| Sample No. | B6-1 | B6-2 | B6-3 | B6-4 | B6-5 | B6-6 | B6-7 | B6-8 |
|---|---|---|---|---|---|---|---|---|
| of first layer region (μ) | | | | | | | | |
| Evaluation | ○ | ⊙ | ⊙ | ⊙ | ⊙ | ○ | ○ | ○ |

⊙Very good
○ Good

TABLE 7B

| Sample No. | B7-1 | B7-2 | B7-3 | B7-4 | B7-5 | B7-6 | B7-7 |
|---|---|---|---|---|---|---|---|
| Si:C target (Area ratio) | 9:1 | 6.5:3.5 | 4:6 | 2:8 | 1:9 | 0.5:9.5 | 0.2:9.8 |
| Si:C (Content ratio) | 9.7:0.3 | 8.8:1.2 | 7.3:2.7 | 4.8:5.2 | 3:7 | 2:8 | 0.8:9.2 |
| Image quality evaluation | Δ | ○ | ⊙ | ⊙ | ○ | Δ | x |

⊙Very good
○ Good
Δ Practically sufficiently usable
x Defective images are formed somewhat

TABLE 8B

| Sample No. | Thickness of amorphous layer (II) (μ) | Result |
|---|---|---|
| B8-1 | 0.001 | Defective images were liable to form. |
| B8-2 | 0.02 | No defective image was formed when repeated 20,000 times. |
| B8-3 | 0.05 | Stable when repeated 50,000 times or more |
| B8-4 | 1 | Stable when repeated 200,000 times or more. |

TABLE 9B

| Layer constitution | | Gas employed | Flow rate (SCCM) | Flow rate ratio | Discharge power (W/cm²) | Layer deposition rate (Å/sec) | Layer thickness (μ) |
|---|---|---|---|---|---|---|---|
| Amorphous layer (I) | First layer region | $SiH_4/He = 1$<br>$SiF_4/He = 1$<br>NO<br>$B_2H_6/He = 10^{-3}$ | $SiH_4 = 100$ | $NO/SiH_4 = 1.5 \times 10^{-2}$<br>$B_2H_6/SiH_4/SiF_4 = 2.0 \times 10^{-4}/0.5/0.5 \sim 0/0.5/0.5$ | 0.18 | 11 | 0.5 |
| | Second layer region | $SiH_4/He = 1$<br>$SiF_4/He = 1$ | $SiH_4 = 100$ | $SiH_4/SiF_4 = 1$ | 0.18 | 11 | 19.5 |

TABLE 1C

| Layer constitution | | Gas employed | Flow rate (SCCM) | Flow rate ratio | Discharge power (W/cm²) | Layer deposition rate (Å/sec) | Layer thickness (μ) |
|---|---|---|---|---|---|---|---|
| Amorphous layer (I) | First layer region | $SiH_4/He = 1$<br>NO<br>$B_2H_6/He = 10^{-3}$ | $SiH_4 = 200$ | $NO/SiH_4 = 1.5 \times 10^{-2}$<br>$B_2H_6/SiH_4 = 2.0 \times 10^{-4} \sim 0$ | 0.18 | 11 | 0.5 |
| | Second layer region | $SiH_4/He = 1$ | $SiH_4 = 200$ | | 0.18 | 11 | 19.5 |
| Amorphous layer (II) | | $SiH_4/He = 0.5$<br>$C_2H_4$ | $SiH_4 = 50$ | $SiH_4:C_2H_4 = 3:7$ | 0.18 | 6 | 0.5 |

Al support temperature: 250° C.
Discharge frequency: 13.56 MHz
Inner pressure of reaction chamber: Amorphous layer (I) 0.3 Torr Amorphous layer (II) 0.5 Torr

TABLE 2C

| Layer constitution | | Gas employed | Flow rate (SCCM) | Flow rate ratio | Discharge power (W/cm²) | Layer deposition rate (Å/sec) | Layer thickness (μ) |
|---|---|---|---|---|---|---|---|
| Amorphous layer (I) | First layer region | $SiH_4/He = 1$<br>NO<br>$B_2H_6/He = 10^{-3}$ | $SiH_4 = 200$ | $NO/SiH_4 = 1.5 \times 10^{-2}$<br>$B_2H_6/SiH_4 = 2.0 \times 10^{-4} \sim 2.5 \times 10^{-5}$ | 0.18 | 11 | 0.5 |
| | Second layer region | $SiH_4/He = 1$<br>$B_2H_6/He = 10^{-3}$ | $SiH_4 = 200$ | $B_2H_6/SiH_4 = 2.5 \times 10^{-5}$ | 0.18 | 11 | 19.5 |
| Amorphous | | $SiH_4/He = 0.5$ | $SiH_4 =$ | $SiH_4:C_2H_4 = 3:7$ | 0.18 | 6 | 0.5 |

TABLE 2C-continued

| Layer constitution | Gas employed | Flow rate (SCCM) | Flow rate ratio | Discharge power (W/cm²) | Layer deposition rate (Å/sec) | Layer thickness (μ) |
|---|---|---|---|---|---|---|
| layer (II) | $C_2H_4$ | 50 | | | | |

Al support temperature: 250° C.
Discharge frequency: 13.56 MHz
Inner pressure of reaction chamber: Amorphous layer (I) 0.3 Torr Amorphous layer (II) 0.5 Torr

TABLE 3C

| Layer constitution | | Gas employed | Flow rate (SCCM) | Flow rate ratio | Discharge power (W/cm²) | Layer deposition rate (Å/sec) | Layer thickness (μ) |
|---|---|---|---|---|---|---|---|
| Amorphous layer (I) | First layer region | $SiH_4/He = 1$ NO $B_2H_6/He = 10^{-3}$ | $SiH_4$ = 200 | $NO/SiH_4 = 1.5 \times 10^{-2}$ $B_2H_6/SiH_4 = 1.5 \times 10^{-4} \sim 7 \times 10^{-5}$ | 0.18 | 11 | 1.0 |
| | Second layer region | $SiH_4/He = 1$ $B_2H_6/He = 10^{-3}$ | $SiH_4$ = 200 | $B_2H_6/SiH_4 = 7 \times 10^{-5} \sim 6.5 \times 10^{-5}$ | 0.18 | 11 | 19.0 |
| Amorphous layer (II) | | $SiH_4/He = 0.5$ $C_2H_4$ | $SiH_4$ = 50 | $SiH_4:C_2H_4 = 3:7$ | 0.18 | 6 | 0.5 |

Al support temperature: 250° C.
Discharge frequency: 13.56 MHz
Inner pressure of reaction chamber: Amorphous layer (I) 0.3 Torr Amorphous layer (II) 0.5 Torr

TABLE 4C

| Sample No. | C4-1 | C4-2 | C4-3 | C4-4 | C4-5 | C4-6 |
|---|---|---|---|---|---|---|
| Distribution figure | FIG. 16 | FIG. 17 | FIG. 18 | FIG. 19 | FIG. 20 | FIG. 21 |
| Evaluation | ◎ | ○ | ◎ | ◎ | ◎ | ◎ |

◎Defective image occured slightly; high image quality
○ Defective image occured slightly; very good adhesion

TABLE 5C

| Sample No. | C5-1 | C5-2 | C5-3 | C5-4 | C5-5 | C5-6 | C5-7 |
|---|---|---|---|---|---|---|---|
| Oxygen Content (atomic %) | 0.003 | 0.05 | 0.5 | 1.0 | 3.0 | 5.0 | 10.0 |
| Evaluation | ○ | ○ | ◎ | ◎ | ◎ | ◎ | ○ |

◎Very good
○ Good

TABLE 6C

| Sample No. | C6-1 | C6-2 | C6-3 | C6-4 | C6-5 | C6-6 | C6-7 | C6-8 |
|---|---|---|---|---|---|---|---|---|
| Thickness | 0.05 | 0.1 | 0.3 | 0.8 | 1.5 | 3 | 7 | 10 |

TABLE 6C-continued

| Sample No. | C6-1 | C6-2 | C6-3 | C6-4 | C6-5 | C6-6 | C6-7 | C6-8 |
|---|---|---|---|---|---|---|---|---|
| of first layer region (μ) | | | | | | | | |
| Evaluation | ○ | ◎ | ◎ | ◎ | ◎ | ○ | ○ | ○ |

◎Very good
○Good

TABLE 7C

| Sample No. | C7-1 | C7-2 | C7-3 | C7-4 | C7-5 | C7-6 | C7-7 | C7-8 |
|---|---|---|---|---|---|---|---|---|
| $SiH_4:C_2H_4$ (Flow rate ratio) | 9:1 | 6:4 | 4:6 | 2:8 | 1:9 | 0.5:9.5 | 0.35:9.65 | 0.2:9.8 |
| Si:C (Content ratio) | 9:1 | 7:3 | 5.5:4.5 | 4:6 | 3:7 | 2:8 | 1.2:8.8 | 0.8:9.2 |
| Image quality evaluation | Δ | ○ | ◎ | ◎ | ◎ | ◎ | Δ | x |

◎Very good
○ Good
Δ Sufficiently practically usable
x Defective images are formed somewhat

TABLE 8C

| Sample No. | Thickness of amorphous layer (II) (μ) | Result |
|---|---|---|
| C8-1 | 0.001 | Defective images were liable to form. |
| C8-2 | 0.02 | No defective image was formed when repeated 20,000 times. |
| C8-3 | 0.05 | No defective image was formed when repeated 50,000 times or more |
| C8-4 | 2 | Stable when repeated 200,000 times or more. |

TABLE 9C

| Layer constitution | | Gas employed | Flow rate (SCCM) | Flow rate ratio | Discharge power (W/cm²) | Layer deposition rate (Å/sec) | Layer thickness (μ) |
|---|---|---|---|---|---|---|---|
| Amorphous layer (I) | First layer region | $SiH_4/He = 1$<br>$SiF_4/He = 1$<br>NO<br>$B_2H_6/He = 10^{-3}$ | $SiH_4 =$ 100 | $NO/SiH_4 = 1.5 \times 10^{-2}$<br>$B_2H_6/SiH_4/SiF_4 =$<br>$2.0 \times 10^{-4}/0.5/0.5 \sim$<br>$0/0.5/0.5$ | 0.18 | 11 | 0.5 |
| | Second layer region | $SiH_4/He = 1$<br>$SiF_4/He = 1$ | $SiH_4 =$ 100 | $SiH_4/SiF_4 = 1$ | 0.18 | 11 | 19.5 |

TABLE 1D

| Layer constitution | | Gas employed | Flow rate (SCCM) | Flow rate ratio | Discharge power (W/cm²) | Layer deposition rate (Å/sec) | Layer thickness (μ) |
|---|---|---|---|---|---|---|---|
| Amorphous layer (I) | First layer region | $SiH_4/He = 1$<br>NO<br>$B_2H_6/He = 10^{-3}$ | $SiH_4 =$ 200 | $NO/SiH_4 = 1.5 \times 10^{-2}$<br>$B_2H_6/SiH_4 = 2.0 \times 10^{-4} \sim 0$ | 0.18 | 11 | 0.5 |
| | Second layer region | $SiH_4/He = 1$ | $SiH_4 =$ 200 | | 0.18 | 11 | 19.5 |
| Amorphous layer (II) | | $SiH_4/He = 0.5$<br>$SiF_4/He = 0.5$<br>$C_2H_4$ | $SiH_4 +$ $SiF_4 =$ 150 | $SiH_4/SiF_4/C_2H_4 =$<br>1.5/1.5/7 | 0.18 | 6 | 0.5 |

Al support temperature: 250° C.
Discharge frequency: 13.56 MHz
Inner pressure of reaction chamber: Amorphous layer (I) 0.3 Torr Amorphous layer (II) 0.5 Torr

TABLE 2D

| Layer construction | | Gas employed | Flow rate (SCCM) | Flow rate ratio | Discharge power (W/cm²) | Layer deposition rate (Å/sec) | Layer thickness (μ) |
|---|---|---|---|---|---|---|---|
| Amorphous layer (I) | First layer region | $SiH_4/He = 1$<br>NO<br>$B_2H_6/He = 10^{-3}$ | $SiH_4 =$ 200 | $NO/SiH_4 = 1.5 \times 10^{-2}$<br>$B_2H_6/SiH_4 =$<br>$2.0 \times 10^{-4} \sim 2.5 \times 10^{-5}$ | 0.18 | 11 | 0.5 |
| | Second layer region | $SiH_4/He = 1$<br>$B_2H_6/He = 10^{-3}$ | $SiH_4 =$ 200 | $B_2H_6/SiH_4 = 2.5 \times 10^{-5}$ | 0.18 | 11 | 19.5 |
| Amorphous layer (II) | | $SiH_4/He = 0.5$<br>$SiF_4/He = 0.5$<br>$C_2H_4$ | $SiH_4 +$ $SiF_4 =$ 150 | $SiH_4/SiF_4/C_2H_4 =$<br>1.5/1.5/7 | 0.18 | 6 | 0.5 |

Al support temperature: 250° C.
Discharge frequency: 13.56 MHz
Inner pressure of reaction chamber: Amorphous layer (I) 0.3 Torr Amorphous layer (II) 0.5 Torr

TABLE 3D

| Layer construction | | Gas employed | Flow rate (SCCM) | Flow rate ratio | Discharge power (W/cm²) | Layer deposition rate (Å/sec) | Layer thickness (μ) |
|---|---|---|---|---|---|---|---|
| Amorphous layer (I) | First layer region | $SiH_4/He = 1$<br>NO<br>$B_2H_6/He = 10^{-3}$ | $SiH_4 =$ 200 | $NO/SiH_4 = 1.5 \times 10^{-2}$<br>$B_2H_6/SiH_4 =$<br>$1.5 \times 10^{-4} \sim 7 \times 10^{-5}$ | 0.18 | 11 | 1.0 |
| | Second layer region | $SiH_4/He = 1$<br>$B_2H_6/He = 10^{-3}$ | $SiH_4 =$ 200 | $B_2H_6/SiH_4 =$<br>$7 \times 10^{-5} \sim 6.5 \times 10^{-5}$ | 0.18 | 11 | 19.0 |
| Amorphous layer (II) | | $SiH_4/He = 0.5$<br>$SiF_4/He = 0.5$<br>$C_2H_4$ | $SiH_4 +$ $SiF_4 =$ 150 | $SiH_4/SiF_4/C_2H_4 =$<br>1.5/1.5/7 | 0.18 | 6 | 0.5 |

Al support temperature: 250° C.
Discharge frequency: 13.56 MHz
Inner pressure of reaction chamber: Amorphous layer (I) 0.3 Torr Amorphous layer (II) 0.5 Torr

TABLE 4D

| Sample No. | D4-1 | D4-2 | D4-3 | D4-4 | D4-5 | D4-6 |
|---|---|---|---|---|---|---|
| Distribution | FIG. 16 | FIG. 17 | FIG. 18 | FIG. 19 | FIG. 20 | FIG. 21 |

TABLE 4D-continued

| Sample No. | D4-1 | D4-2 | D4-3 | D4-4 | D4-5 | D4-6 |
|---|---|---|---|---|---|---|
| Figure Evaluation | ⊙ | ○ | ⊙ | ⊙ | ⊙ | ⊙ |

⊙No defective image; high image quality
○ No defective image; very good adhesion

TABLE 5D

| Sample No. | D5-1 | D5-2 | D5-3 | D5-4 | D5-5 | D5-6 | D5-7 |
|---|---|---|---|---|---|---|---|
| Oxygen Content (atomic %) | 0.003 | 0.05 | 0.5 | 1.0 | 3.0 | 5.0 | 10.0 |
| Evaluation | ○ | ○ | ⊙ | ⊙ | ⊙ | ⊙ | ○ |

⊙Very good
○ Good

TABLE 6D

| Sample No. | D6-1 | D6-2 | D6-3 | D6-4 | D6-5 | D6-6 | D6-7 | D6-8 |
|---|---|---|---|---|---|---|---|---|
| Thickness of first layer (μ) | 0.05 | 0.1 | 0.3 | 0.8 | 1.5 | 3 | 7 | 10 |
| Image quality Evaluation | ○ | ⊙ | ⊙ | ⊙ | ⊙ | ○ | ○ | ○ |

⊙Very good
○ Good

TABLE 7D

| Sample No. | D7-1 | D7-2 | D7-3 | D7-4 | D7-5 | D7-6 | D7-7 | D7-8 |
|---|---|---|---|---|---|---|---|---|
| $SiH_4$:$SiF_4$:$C_2H_4$ | 5:4:1 | 3:3.5:3.5 | 2:2:6 | 1:1:8 | 0.6:0.4:9 | 0.2:0.3:9.5 | 0.2:0.15:9.65 | 0.1:0.1:9.8 |
| Si:C (Content ratio) | 9:1 | 7:3 | 5.5:4.5 | 4:6 | 3:7 | 2:8 | 1.2:8.8 | 0.8:9.2 |
| Evaluation | Δ | ○ | ⊙ | ⊙ | ⊙ | ○ | Δ | x |

⊙Very good
○ Good
Δ Sufficiently practically usable
x Defective images are formed somewhat

TABLE 8D

| Sample No. | Thickness of amorphous layer (II) (μ) | Result |
|---|---|---|
| D8-1 | 0.001 | Defective images were liable to form. |
| D8-2 | 0.02 | No defective image was formed when repeated 20,000 times. |
| D8-3 | 0.05 | Stable when repeated 50,000 times or more |
| D8-4 | 1 | Stable when repeated 200,000 times or more. |

TABLE 9D

| Layer construction | | Gas employed | Flow rate (SCCM) | Flow rate ratio | Discharge power (W/cm²) | Layer deposition rate (Å/sec) | Layer thickness (μ) |
|---|---|---|---|---|---|---|---|
| Amorphous layer (I) | First layer region | $SiH_4$/He = 1<br>$SiF_4$/He = 1<br>NO<br>$B_2H_6$/He = $10^{-3}$ | $SiH_4$ = 100 | NO/$SiH_4$ = $1.5 \times 10^{-2}$<br>$B_2H_6$/$SiH_4$/$SiF_4$ = $2.0 \times 10^{-4}$/0.5/0.5 ~ 0/0.5/0.5 | 0.18 | 11 | 0.5 |
| | Second layer region | $SiH_4$/He = 1<br>$SiF_4$/He = 1 | $SiH_4$ = 100 | $SiH_4$/$SiF_4$ = 1 | 0.18 | 11 | 19.5 |

We claim:

1. A photoconductive member which comprises a support for a photoconductive member and an amorphous layer having photoconductivity and containing an amorphous material comprising silicon atom as a matrix, said amorphous layer having a first layer region containing oxygen atoms, a second layer region containing Group III atoms of the Periodic Table such that said Group III atoms are continuously distributed in the direction of the layer thickness and enriched at the support side, and wherein oxygen is absent from said amorphous layer exclusive of the first layer region, said first layer region being present internally in the support side portion of the amorphous layer, and there being the following relationship:

$$To/T \leqq 1$$

where $T_0$ is the layer thickness of the first layer region and T results from subtracting To from the layer thickness of the amorphous layer; To is 50 microns or less; T is 0.5 micron or more and the sum of (To+T) is 1 to 100 microns.

2. A photoconductive member according to claim 1 in which the first layer region and the second layer region share in common at least a portion of said mutual region.

3. A photoconductive member according to claim 1 in which the second layer region occupies the substantially whole layer region of the amorphous layer.

4. A photoconductive member according to claim 1 in which the first layer region is provided as an end layer region at the support side of the amorphous layer.

5. A photoconductive member according to claim 1 in which the second layer region is provided as an end layer region at the support side of the amorphous layer.

6. A photoconductive member according to claim 1 in which the amorphous layer contains hydrogen atoms.

7. A photoconductive member according to claim 6 in which the content of hydrogen atoms in the amorphous layer is 1–40 atomic %.

8. A photoconductive member according to claim 1 in which the amorphous layer contains halogen atoms.

9. A photoconductive member according to claim 8 in which the content of halogen atoms in the amorphous layer is 1–40 atomic %.

10. A photoconductive member according to claim 1 in which the amorphous layer contains both hydrogen atoms and halogen atoms.

11. A photoconductive member according to claim 10 in which the total content of hydrogen atoms and halogen atoms in the amorphous layer is 1–40 atomic %.

12. A photoconductive member according to claim 1 in which the content of oxygen atoms in the first layer region is 0.001–50 atomic %.

13. A photoconductive member according to claim 1 in which the content of the Group III atoms in the second layer region is $0.01–5\times10^4$ atomic ppm.

14. A photoconductive member according to claim 1 in which the second layer region has the maximum concentration of the Group III atoms ($C_{max}$) in the end layer region at the support side.

15. A photoconductive member according to claim 13 in which $C_{max}$ is 50 atomic ppm or more.

16. A photoconductive member according to claim 13 in which $C_{max}$ is in the layer region within 5μ from the end portion at the support side in the second layer region.

17. A photoconductive member according to claim 1 in which an amorphous layer comprising an amorphous material containing silicon atoms and carbon atoms is disposed on the amorphous layer having photoconductivity.

18. A photoconductive member according to claim 16 in which the amorphous material containing carbon atoms contains further hydrogen atoms.

19. A photoconductive member according to claim 16 in which the amorphous material containing carbon atoms contains further halogen atoms.

20. A photoconductive member according to claim 16 in which the amorphous material containing carbon atoms contains further both hydrogen atoms and halogen atoms.

21. A photoconductive member according to claim 16 in which the thickness of the amorphous layer containing carbon atoms is 0.003–30μ.

* * * * *

UNITED STATES PATENT AND TRADEMARK OFFICE

CERTIFICATE OF CORRECTION

PATENT NO. : 4,795,688

DATED : January 3, 1989

INVENTOR(S) : TERUO MISUMI, ET AL.

It is certified that error appears in the above-identified patent and that said Letters Patent is hereby corrected as shown below:

Title page:

BEFORE [63] RELATED U.S. APPLICATION DATA

Insert, --[30] Foreign Application Priority Data

| | | | |
|---|---|---|---|
| Mar. 15, 1982 | [JP] | Japan | ..... 57-40627 |
| Mar. 15, 1982 | [JP] | Japan | ..... 57-40628 |
| Mar. 15, 1982 | [JP] | Japan | ..... 57-40629 |
| Mar. 15, 1982 | [JP] | Japan | ..... 57-40630 |

IN [57] ABSTRACT

Line 7, "Such" should read --such--.

SHEET 4

FIG. 13, "1334 should read --1324
1304 1304
1335 1325
1305" 1305--.

COLUMN 1

Line 21, "solid state" should read --solid-state--.
Line 30, "solid state" should read --solid-state--.

COLUMN 2

Line 23, "solid state" should read --solid-state--.
Line 40, "above men-" should read --above-men- --.

UNITED STATES PATENT AND TRADEMARK OFFICE

CERTIFICATE OF CORRECTION

PATENT NO. : 4,795,688

DATED : January 3, 1989

INVENTOR(S) : TERUO MISUMI, ET AL.

It is certified that error appears in the above-identified patent and that said Letters Patent is hereby corrected as shown below:

COLUMN 3

Lines 42-43, "in support" should read --preferably--.

COLUMN 4

Line 55, "characteristics" should read --characteristic--.

COLUMN 6

Line 33, "because" should read --between--.

COLUMN 7

Line 40, "abovementioned" should read --above-mentioned--.

COLUMN 8

Line 51, "abovementioned" should read --above-mentioned--.

Line 67, "abovementioned" should read --above-mentioned--.

UNITED STATES PATENT AND TRADEMARK OFFICE

CERTIFICATE OF CORRECTION

PATENT NO. : 4,795,688

DATED : January 3, 1989

INVENTOR(S) : TERUO MISUMI, ET AL.

It is certified that error appears in the above-identified patent and that said Letters Patent is hereby corrected as shown below:

COLUMN 9

Line 4, "abovemen-" should read --above-men- --.
Line 7, "abovementioned" should read --above-mentioned--.
Line 24, "abovemen-" should read --above-men- --.
Line 58, "abovementioned" should read --above-mentioned--.
Line 65, "abovementioned" should read --above-mentioned--.

COLUMN 11

Line 4, "so called" should read --so-called--.
Line 27, "containd," should read --contained,--.

COLUMN 13

Line 24, "parafinic" should read --paraffinic--.
Line 52, "so called" should read --so-called--.

COLUMN 14

Line 61, "preferably" should read --preferable--.

COLUMN 15

Line 62, "or" (first occurrence) should read --of--.

UNITED STATES PATENT AND TRADEMARK OFFICE

CERTIFICATE OF CORRECTION

PATENT NO. : 4,795,688

DATED : January 3, 1989

INVENTOR(S) : TERUO MISUMI, ET AL.

It is certified that error appears in the above-identified patent and that said Letters Patent is hereby corrected as shown below:

COLUMN 16

Line 14, "$SiH_4$/HE" should read --$SiH_4$/He-- and "$B_2H_6$," should read --$B_2H_6$--.
Line 16, "$Si_2H_6$," should read --$Si_2H_6$--.
Line 25, "inflow valve 1212-1216," should read --inflow valves 1212-1216,--.
Line 41, "pressure gauges 1226, 1228 and 1230" should read --pressure gauges 1227, 1228 and 1230--.

COLUMN 17

Line 11, "is formed" should read --to be formed--.
Line 35, "auxiliary valve 1232 and 1233" should read --auxiliary valves 1232 and 1233--.

COLUMN 18

Line 49, "$SiF_4$,/He" should read --$SiF_4$/He--.

COLUMN 19

Line 13, "vaccum" should read --vaccuum--.
Line 19, "abovementioned" should read --above-mentioned--.

UNITED STATES PATENT AND TRADEMARK OFFICE

CERTIFICATE OF CORRECTION

PATENT NO. : 4,795,688

DATED : January 3, 1989

INVENTOR(S) : TERUO MISUMI, ET AL.

It is certified that error appears in the above-identified patent and that said Letters Patent is hereby corrected as shown below:

COLUMN 20

Line 39, "⊕charged developer" should read --⊖charged developer--.
Line 43, "abovementioned" should read --above-mentioned--.
Line 65, "abovementioned" should read --above-mentioned--.
Line 66, "reported." should read --repeated.--.

COLUMN 21

Line 19, "abovementioned" should read --above-mentioned--.

COLUMN 22

Line 25, "abovementioned" should read --above-mentioned--.
Line 26, "reported." should read --repeated.--.
Line 48, "abovementioned" should read --above-mentioned--.
Line 49, "reported." should read --repeated.--.

UNITED STATES PATENT AND TRADEMARK OFFICE

CERTIFICATE OF CORRECTION

PATENT NO. : 4,795,688

DATED : January 3, 1989

INVENTOR(S) : TERUO MISUMI, ET AL.

It is certified that error appears in the above-identified patent and that said Letters Patent is hereby corrected as shown below:

COLUMN 23

Line 2, "abovementioned" should read --above-mentioned--.
Line 47, "Table 8," should read --Table 8C,-- and "uniform" should read --formation--.
Line 48, "Table 8." should read --Table 8C.--.

COLUMN 24

Line 6, "abovementioned" should read --above-mentioned--.
Line 28, "abovementioned" should read --above-mentioned--.
Line 42, "expsoure" should read --exposure--.
Line 51, "abovementioned" should read --above-mentioned--.

UNITED STATES PATENT AND TRADEMARK OFFICE

CERTIFICATE OF CORRECTION

PATENT NO. : 4,795,688

DATED : January 3, 1989

INVENTOR(S) : TERUO MISUMI, ET AL. Page 7 of 7

It is certified that error appears in the above-identified patent and that said Letters Patent is hereby corrected as shown below:

COLUMN 36

Line 25, "$T_o$" should read --To--.

Signed and Sealed this

Third Day of April, 1990

*Attest:*

HARRY F. MANBECK, JR.

*Attesting Officer*

*Commissioner of Patents and Trademarks*